US009899000B2

(12) United States Patent
Takahota et al.

(10) Patent No.: US 9,899,000 B2
(45) Date of Patent: Feb. 20, 2018

(54) DISPLAY, DISPLAY CONTROL METHOD, DISPLAY CONTROL DEVICE, AND ELECTRONIC APPARATUS

(71) Applicant: Sony Corporation, Tokyo (JP)

(72) Inventors: Noriyoshi Takahota, Kanagawa (JP); Takashi Hirakawa, Tokyo (JP); Eiji Kato, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/422,103

(22) PCT Filed: Jun. 17, 2014

(86) PCT No.: PCT/JP2014/003229
§ 371 (c)(1),
(2) Date: Feb. 17, 2015

(87) PCT Pub. No.: WO2014/208046
PCT Pub. Date: Dec. 31, 2014

(65) Prior Publication Data

US 2015/0235620 A1 Aug. 20, 2015

(30) Foreign Application Priority Data

Jun. 25, 2013 (JP) ..... 2013-132443

(51) Int. Cl.
*G09G 5/10* (2006.01)
*G09G 5/18* (2006.01)
*G09G 3/36* (2006.01)

(52) U.S. Cl.
CPC ..... *G09G 5/10* (2013.01); *G09G 3/3696* (2013.01); *G09G 5/18* (2013.01)

(58) Field of Classification Search
CPC ..... G09G 5/10; G09G 5/18; G09G 3/3696
See application file for complete search history.

(56) References Cited

U.S. PATENT DOCUMENTS 8,411,134 B2 4/2013 Tomita
8,570,242 B2 10/2013 Chosokabe et al.
(Continued)

FOREIGN PATENT DOCUMENTS

CN 1940610 A 4/2007
CN 1957269 A 5/2007
(Continued)

OTHER PUBLICATIONS

U.S. Appl. No. 15/454,472, filed Mar. 9, 2017, Ato et al.
(Continued)

*Primary Examiner* — Amare Mengistu
*Assistant Examiner* — Jennifer Zubajlo
(74) *Attorney, Agent, or Firm* — Wolf, Greenfield & Sacks, P.C.

(57) ABSTRACT

A display device configured to display at least one image. The display device includes at least one light emitter configured to emit a plurality of colored light beams, each of the plurality of colored light beams being a respective color different than the others; and a light emission controller configured to determine, based on at least one characteristic of the at least one image, one or more light beams of the plurality of colored light beams to emit in a frame period corresponding to the at least one image.

18 Claims, 20 Drawing Sheets

(56) References Cited

U.S. PATENT DOCUMENTS

| | | | | |
|---|---|---|---|---|
| 8,675,027 | B2 * | 3/2014 | Nakano | G09G 3/3413 345/46 |
| 8,797,433 | B2 | 8/2014 | Kaizu et al. | |
| 8,861,090 | B2 | 10/2014 | Mukawa | |
| 8,907,865 | B2 | 12/2014 | Miyawaki et al. | |
| 8,976,453 | B2 | 3/2015 | Akutsu et al. | |
| 8,988,315 | B2 | 3/2015 | Mukawa et al. | |
| 9,016,864 | B2 | 4/2015 | Sasazaki et al. | |
| 9,164,221 | B2 | 10/2015 | Akutsu et al. | |
| 9,201,242 | B2 | 12/2015 | Miyawaki et al. | |
| 9,311,752 | B2 | 4/2016 | Chosokabe et al. | |
| 9,451,244 | B2 | 9/2016 | Sasazaki et al. | |
| 9,488,846 | B2 | 11/2016 | Hayashi | |
| 9,558,540 | B2 | 1/2017 | Mukawa | |
| 9,569,897 | B2 | 2/2017 | Miyawaki et al. | |
| 9,658,456 | B2 * | 5/2017 | Mukawa | G02B 27/0172 |
| 9,709,809 | B2 | 7/2017 | Miyawaki et al. | |
| 9,726,890 | B2 | 8/2017 | Akutsu et al. | |
| 9,753,284 | B2 | 9/2017 | Machida et al. | |
| 9,759,920 | B2 | 9/2017 | Akutsu et al. | |
| 9,766,453 | B2 | 9/2017 | Mukawa | |
| 2002/0030636 | A1 | 3/2002 | Richards | |
| 2007/0152945 | A1 | 7/2007 | Park et al. | |
| 2007/0176943 | A1 | 8/2007 | Cho | |
| 2007/0205969 | A1 * | 9/2007 | Hagood | G02B 26/004 345/84 |
| 2007/0229444 | A1 * | 10/2007 | Liu | G09G 3/3413 345/102 |
| 2008/0143736 | A1 * | 6/2008 | Clatanoff | G09G 3/3406 345/590 |
| 2008/0158685 | A1 * | 7/2008 | Amitai | G02B 6/0018 359/630 |
| 2009/0058794 | A1 * | 3/2009 | Iwamoto | G09G 3/18 345/102 |
| 2009/0079769 | A1 | 3/2009 | Iisaka et al. | |
| 2009/0295839 | A1 * | 12/2009 | Furukawa | G09G 3/3413 345/690 |
| 2010/0103078 | A1 | 4/2010 | Mukawa et al. | |
| 2010/0128107 | A1 | 5/2010 | Tomita | |
| 2011/0025729 | A1 | 2/2011 | Yamazaki et al. | |
| 2011/0075282 | A1 | 3/2011 | Aoki et al. | |
| 2011/0150501 | A1 | 6/2011 | Guttag et al. | |
| 2011/0157244 | A1 * | 6/2011 | Nakano | G09G 3/3413 345/690 |
| 2011/0241975 | A1 | 10/2011 | Mukawa et al. | |
| 2011/0248904 | A1 | 10/2011 | Miyawaki et al. | |
| 2011/0248905 | A1 | 10/2011 | Chosokabe et al. | |
| 2011/0298894 | A1 * | 12/2011 | Jarvenpaa | H04N 13/0422 348/46 |
| 2012/0007900 | A1 * | 1/2012 | Murai | G09G 3/3413 345/690 |
| 2012/0044571 | A1 | 2/2012 | Mukawa | |
| 2012/0127434 | A1 | 5/2012 | Sasazaki et al. | |
| 2012/0218426 | A1 | 8/2012 | Kaizu et al. | |
| 2013/0128611 | A1 | 5/2013 | Akutsu et al. | |
| 2013/0135749 | A1 | 5/2013 | Akutsu et al. | |
| 2013/0242555 | A1 | 9/2013 | Mukawa | |
| 2013/0300766 | A1 | 11/2013 | Mukawa | |
| 2014/0022284 | A1 | 1/2014 | Chosokabe et al. | |
| 2014/0043353 | A1 | 2/2014 | Ishihara | |
| 2014/0092105 | A1 | 4/2014 | Guttag et al. | |
| 2014/0334010 | A1 | 11/2014 | Mukawa | |
| 2014/0340286 | A1 | 11/2014 | Machida et al. | |
| 2014/0340550 | A1 | 11/2014 | Kaizu et al. | |
| 2014/0347252 | A1 | 11/2014 | Miyawaki et al. | |
| 2015/0062699 | A1 | 3/2015 | Hayashi | |
| 2015/0109679 | A1 | 4/2015 | Mukawa et al. | |
| 2015/0138647 | A1 | 5/2015 | Akutsu et al. | |
| 2015/0226970 | A1 | 8/2015 | Mukawa | |
| 2015/0229897 | A1 | 8/2015 | Mukawa | |
| 2015/0260995 | A1 | 9/2015 | Mukawa | |
| 2015/0269784 | A1 | 9/2015 | Miyawaki et al. | |
| 2015/0277125 | A1 | 10/2015 | Hirano et al. | |
| 2015/0277126 | A1 | 10/2015 | Hirano et al. | |
| 2015/0288954 | A1 | 10/2015 | Sasazaki et al. | |
| 2015/0338660 | A1 | 11/2015 | Mukawa | |
| 2015/0346494 | A1 | 12/2015 | Tanaka et al. | |
| 2015/0362735 | A1 | 12/2015 | Akutsu et al. | |
| 2015/0370075 | A1 | 12/2015 | Ato et al. | |
| 2016/0041394 | A1 | 2/2016 | Tanaka et al. | |
| 2016/0062123 | A1 | 3/2016 | Tanaka et al. | |
| 2016/0097931 | A1 | 4/2016 | Takahota et al. | |
| 2016/0147069 | A1 | 5/2016 | Tanaka et al. | |
| 2017/0069140 | A1 | 3/2017 | Mukawa | |
| 2017/0115492 | A1 | 4/2017 | Miyawaki et al. | |
| 2017/0184857 | A1 | 6/2017 | Ato et al. | |

FOREIGN PATENT DOCUMENTS

| | | | | |
|---|---|---|---|---|
| CN | 101013178 | A | 8/2007 | |
| CN | 102356425 | A | 2/2012 | |
| EP | 0 997 868 | | 5/2000 | |
| EP | 1379082 | A1 | 1/2004 | |
| EP | 2410509 | A1 | 1/2012 | |
| JP | 09-244166 | A | 9/1997 | |
| JP | EP 0997868 | A1 * | 5/2000 | G09G 3/003 |
| JP | 2000-199886 | A | 7/2000 | |
| JP | 2001-203956 | A | 7/2001 | |
| JP | 2003-248462 | A | 9/2003 | |
| JP | 2003248462 | A * | 9/2003 | |
| JP | 2005-521099 | A | 7/2005 | |
| JP | 2006-162767 | | 6/2006 | |
| JP | 2007-094175 | | 4/2007 | |
| JP | 2007-183545 | A | 7/2007 | |
| JP | 2007-206698 | A | 8/2007 | |
| JP | 2008-129302 | A | 6/2008 | |
| JP | 2008-225292 | A | 9/2008 | |
| JP | 2009-020384 | A | 1/2009 | |
| JP | 2009-134156 | A | 6/2009 | |
| JP | 2010-055120 | A | 3/2010 | |
| JP | 2010-224065 | A | 10/2010 | |
| JP | EP 2410509 | A1 * | 1/2012 | G09G 3/3413 |
| NL | EP 1379082 | A1 * | 1/2004 | F21V 33/0052 |
| WO | WO 2006/061927 | A1 | 6/2006 | |
| WO | WO 2012/157553 | A1 | 11/2012 | |

OTHER PUBLICATIONS

European Communication pursuant to Article 94(3) EPC dated Mar. 23, 2017 in connection with European Application No. 14 744 204.0-1914.

Chinese Office Action dated Mar. 31, 2017 in connectoin with Chinese Application No. 201480002108.2, and an informal English translation prepared by counsel handling this Chinese application.

U.S. Appl. No. 15/658,601, filed Jul. 25, 2017, Machida et al.

Japanese Office Action dated Oct. 26, 2017 in connection with Japanese Application No. 2013-132443 and English translation thereof.

* cited by examiner

[Fig. 1]
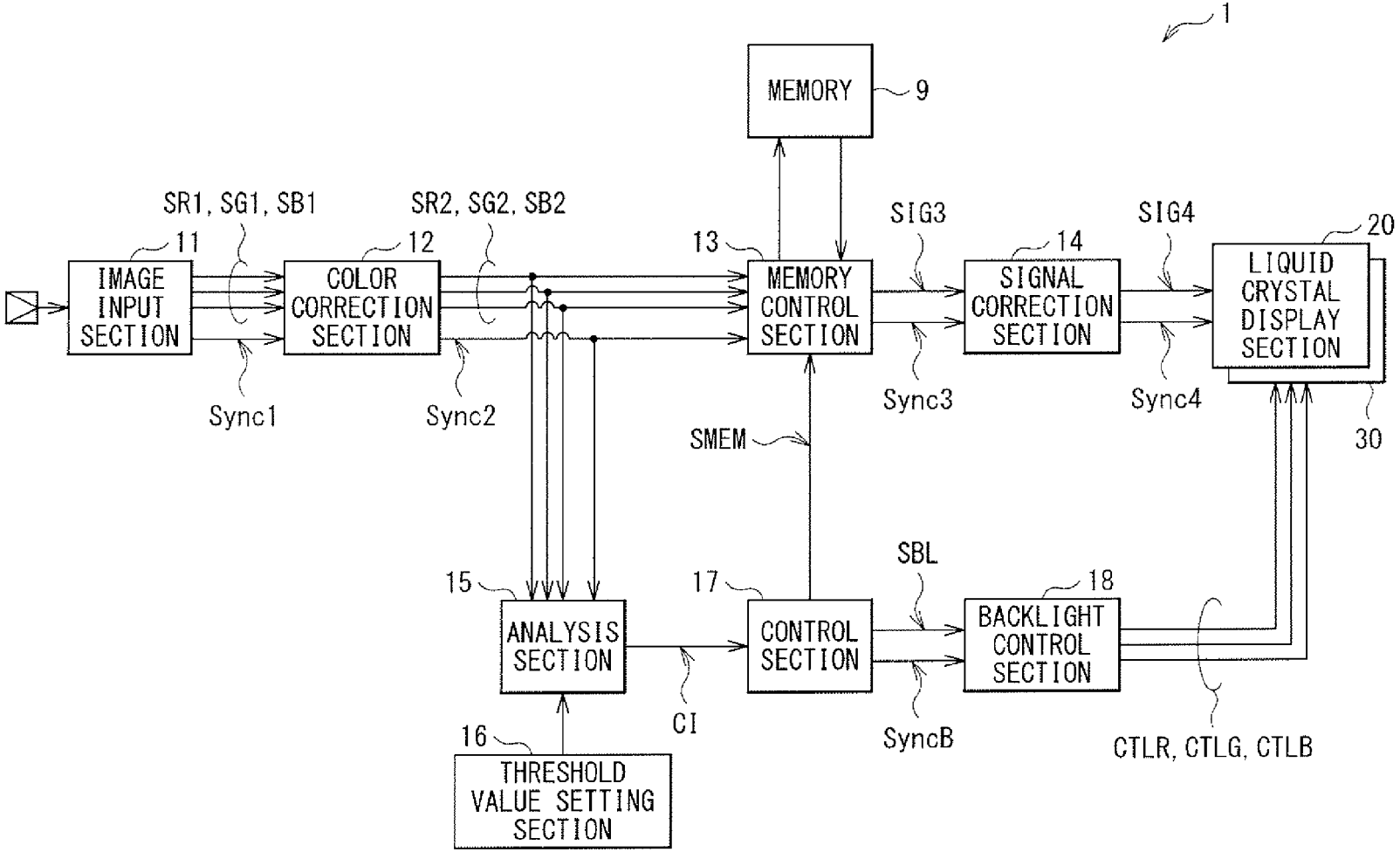

[Fig. 2]
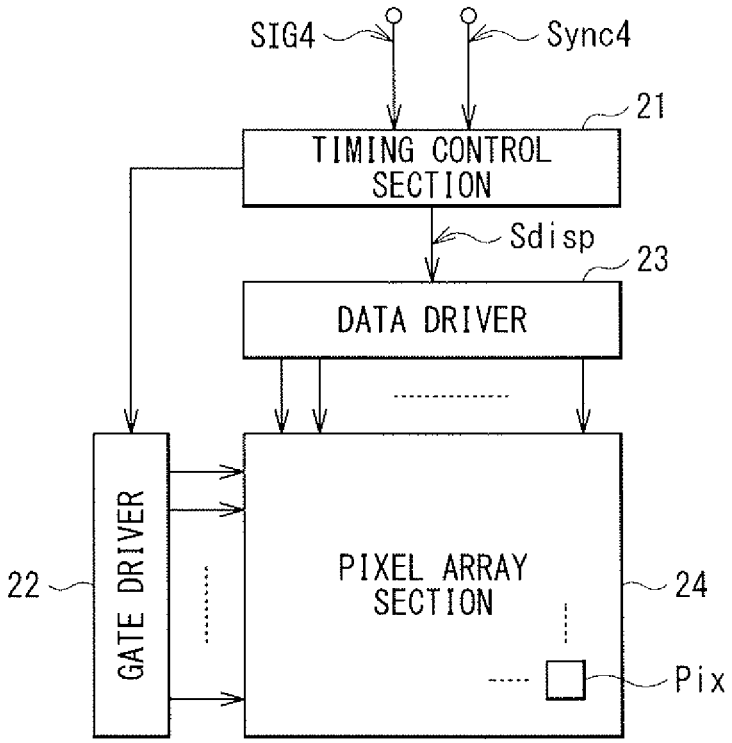
[Fig. 3]
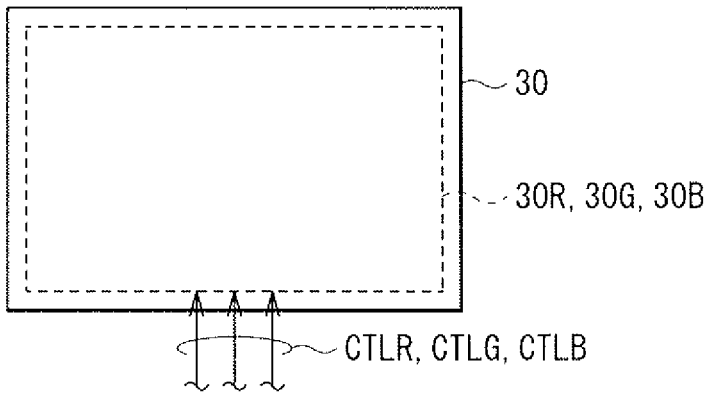

[Fig. 4]
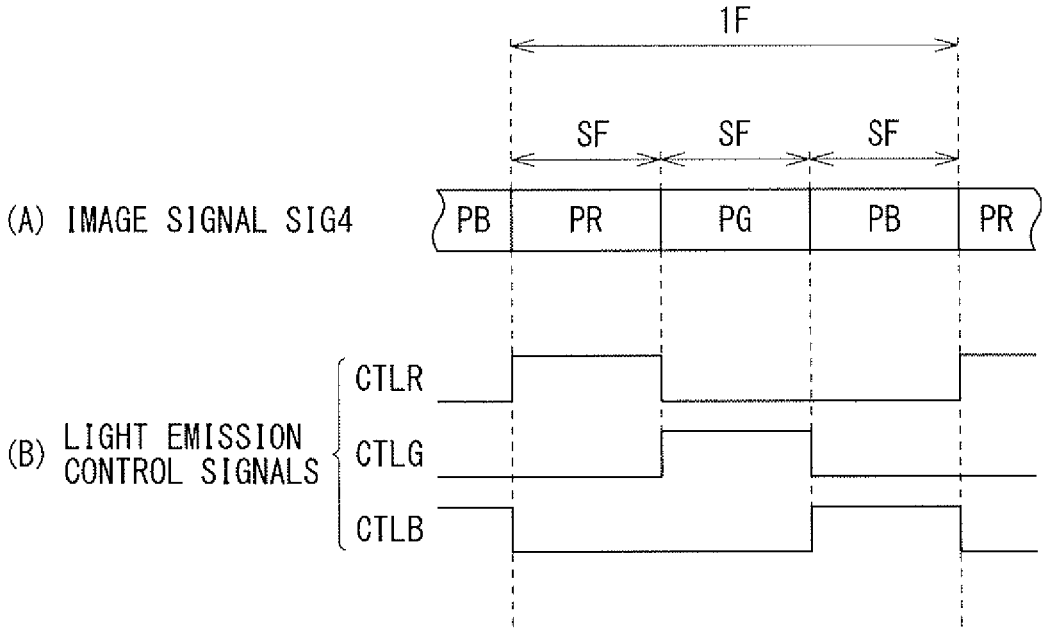
[Fig. 5]
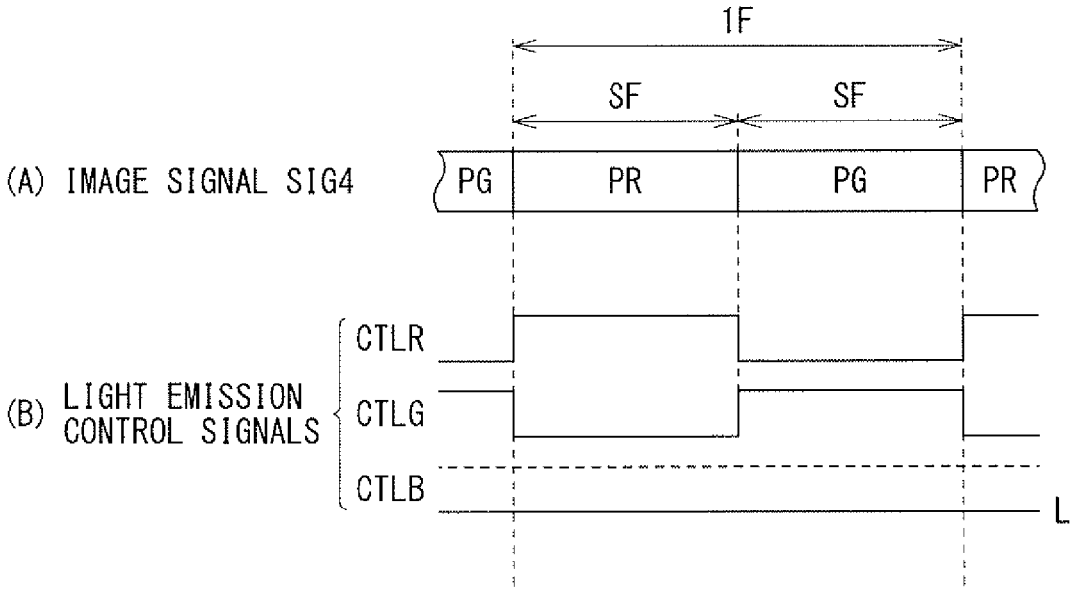

[Fig. 6]
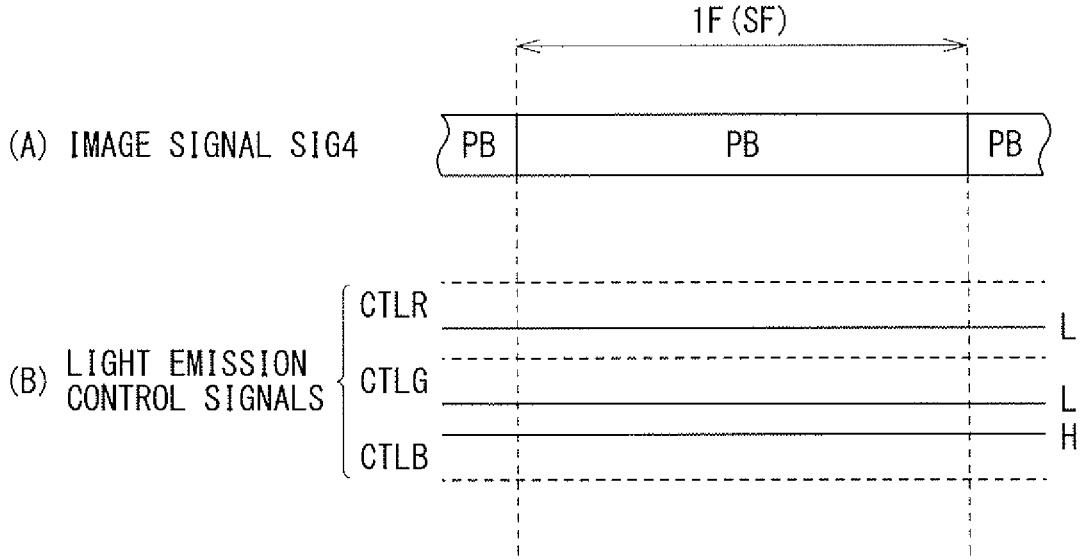

[Fig. 7]
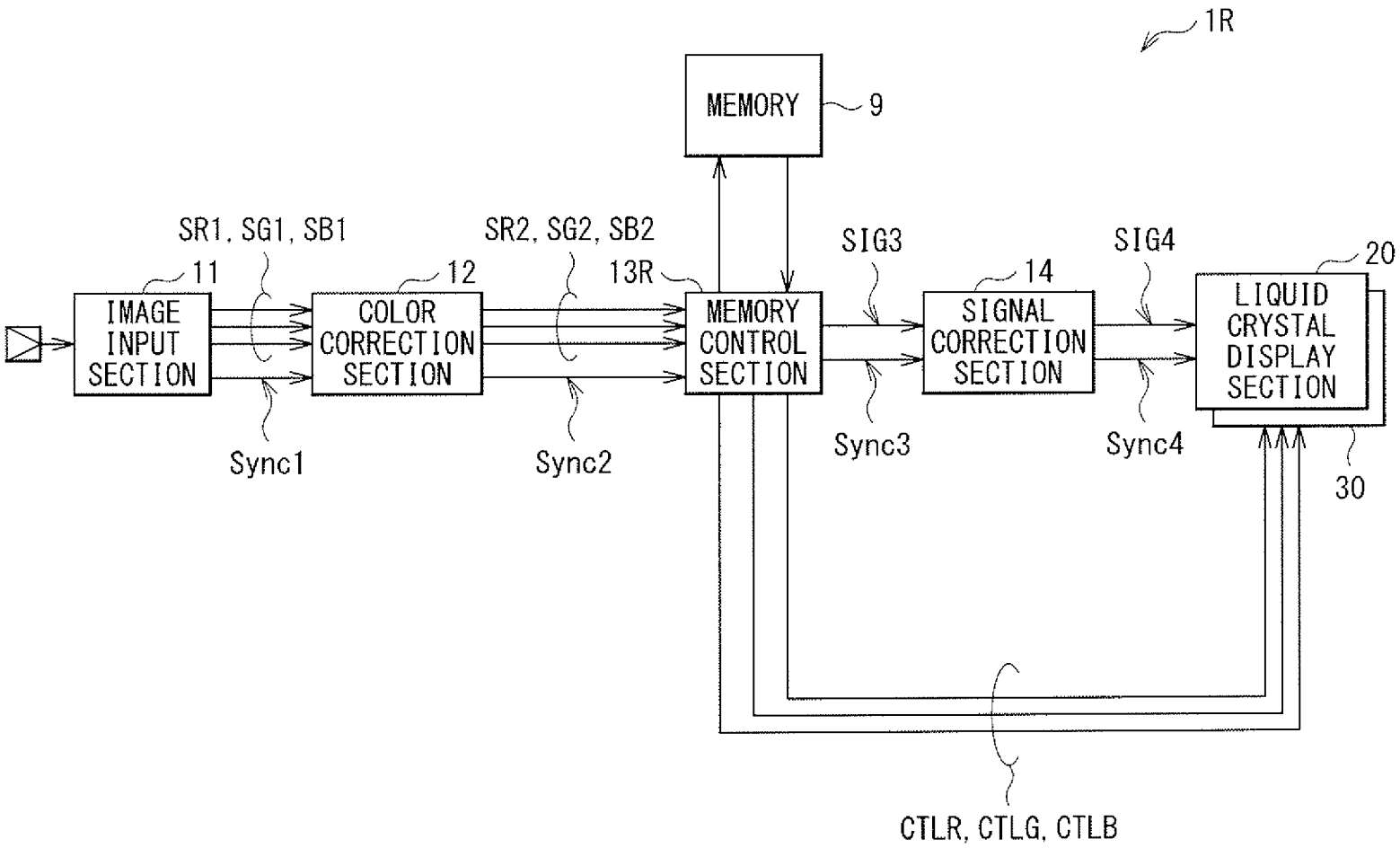

[Fig. 8]
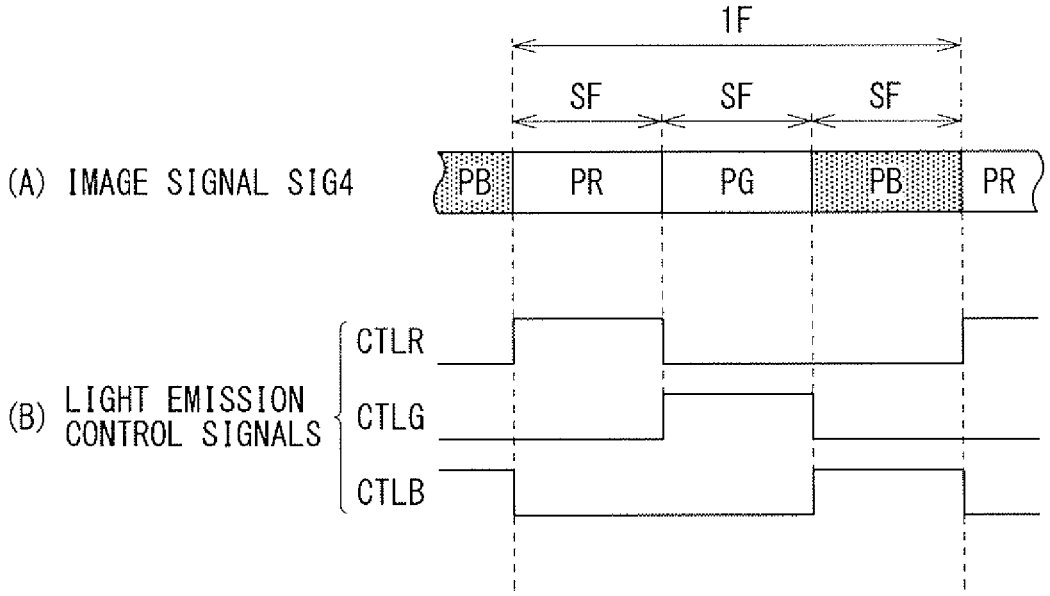
[Fig. 9]
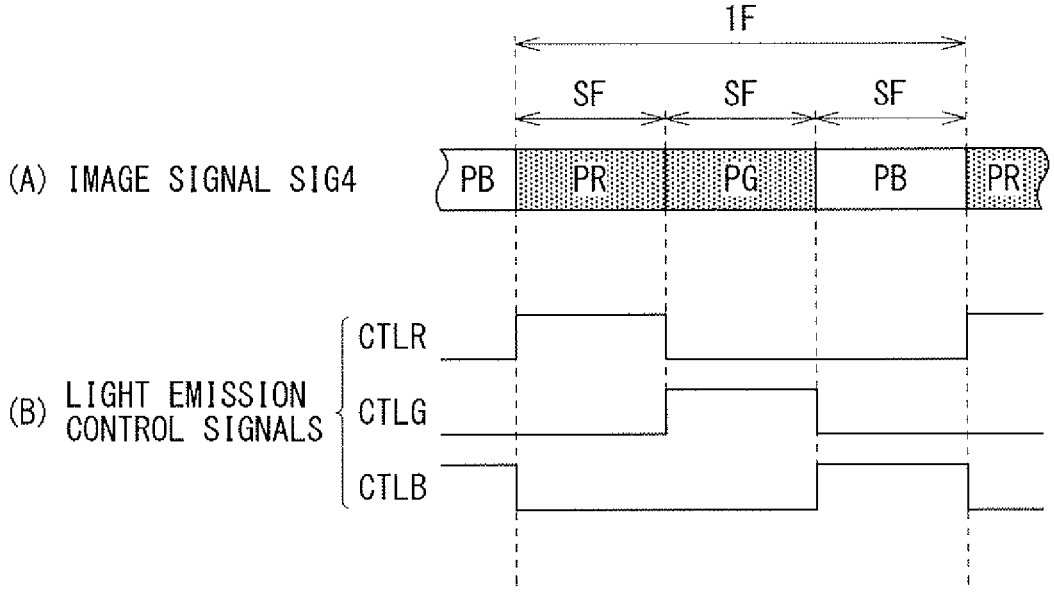

[Fig. 10]
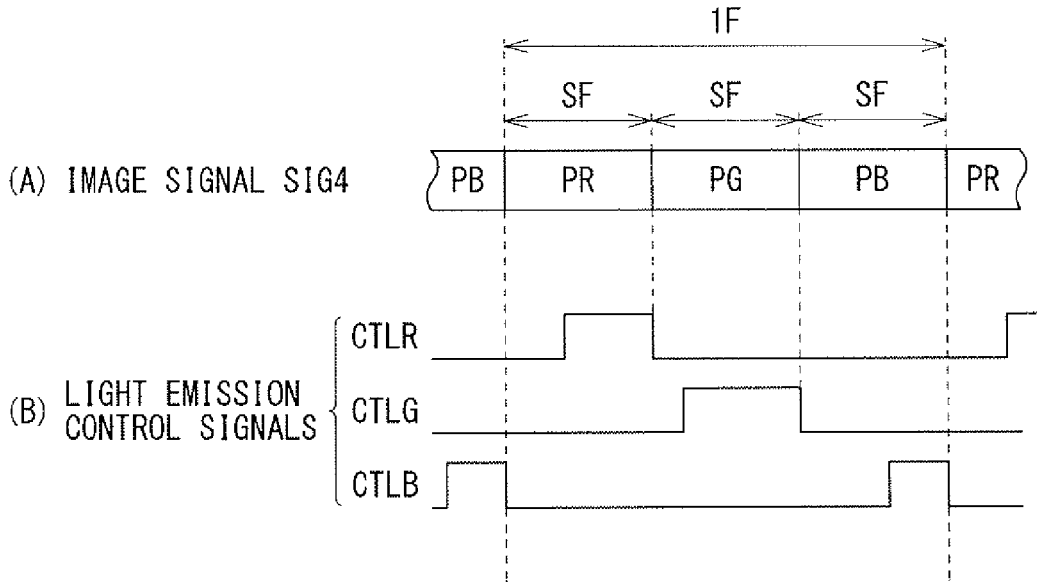
[Fig. 11]
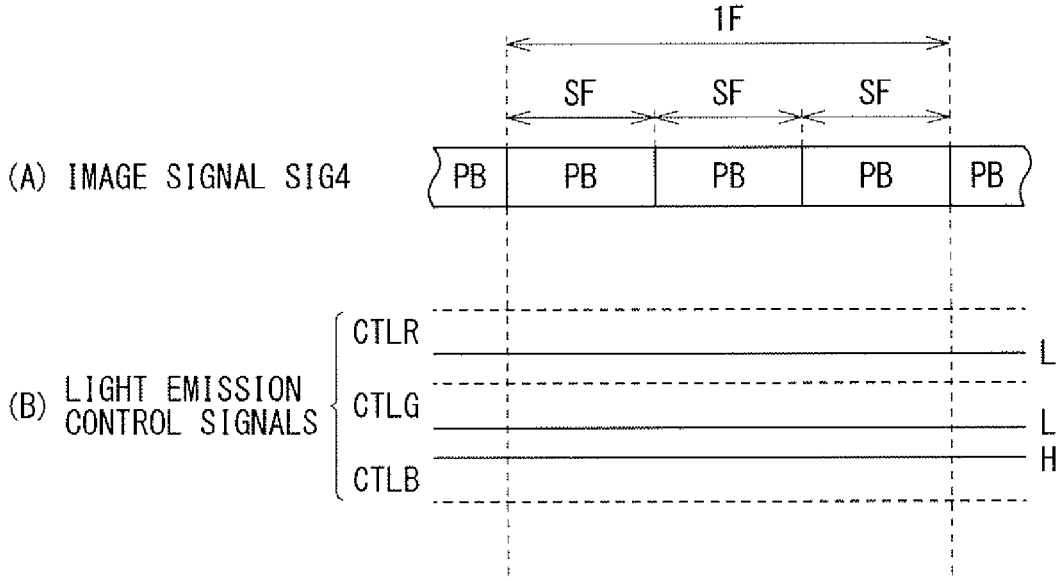

[Fig. 12]
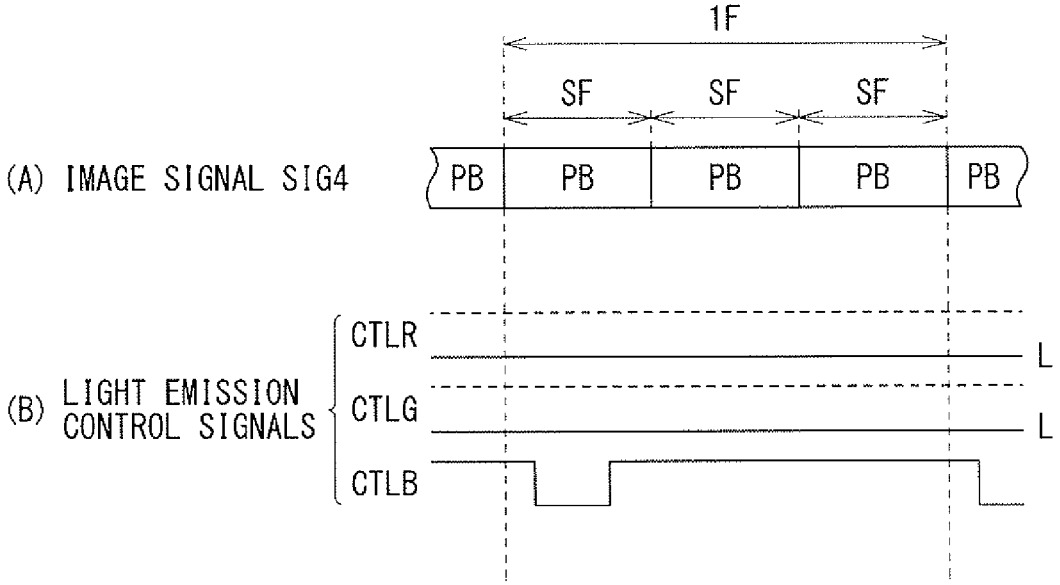
[Fig. 13]
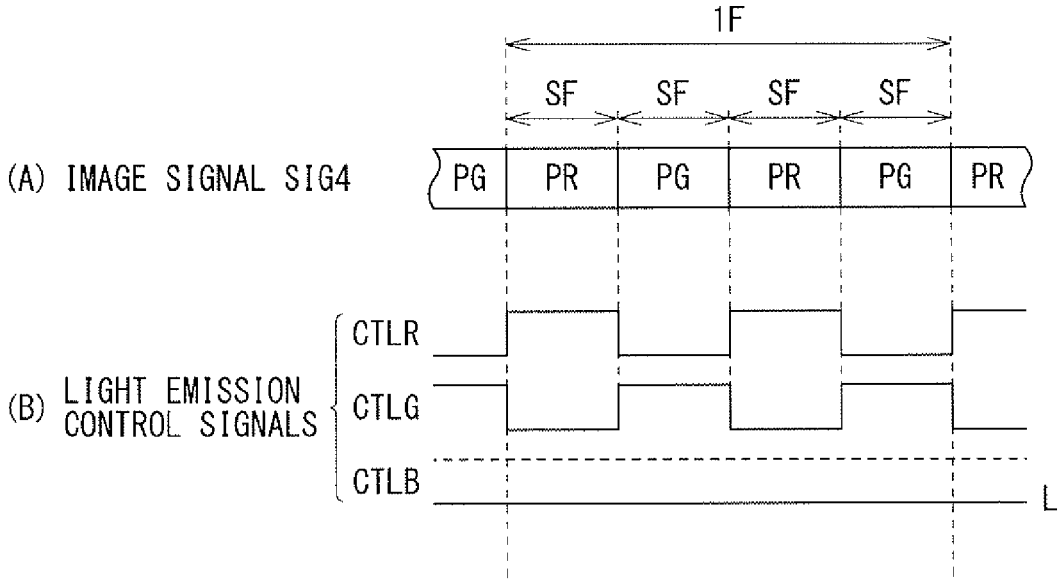

[Fig. 14]
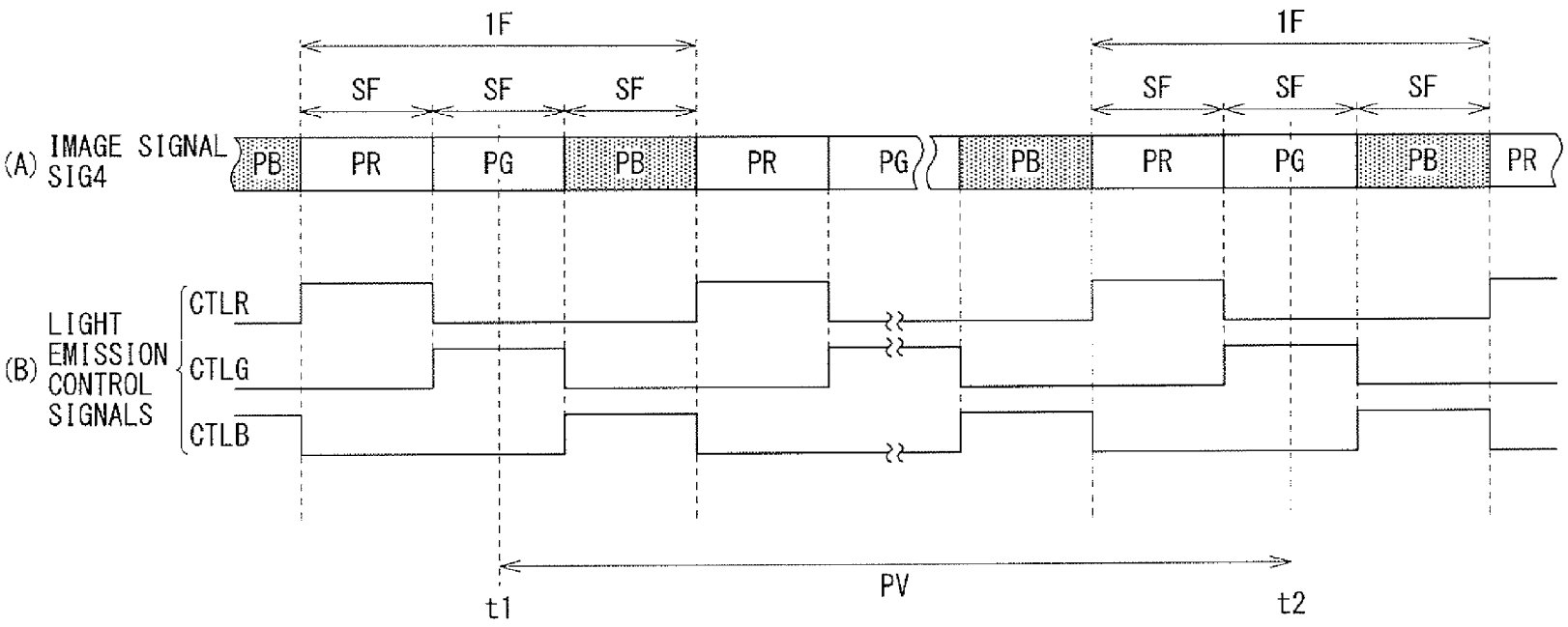

[Fig. 15]
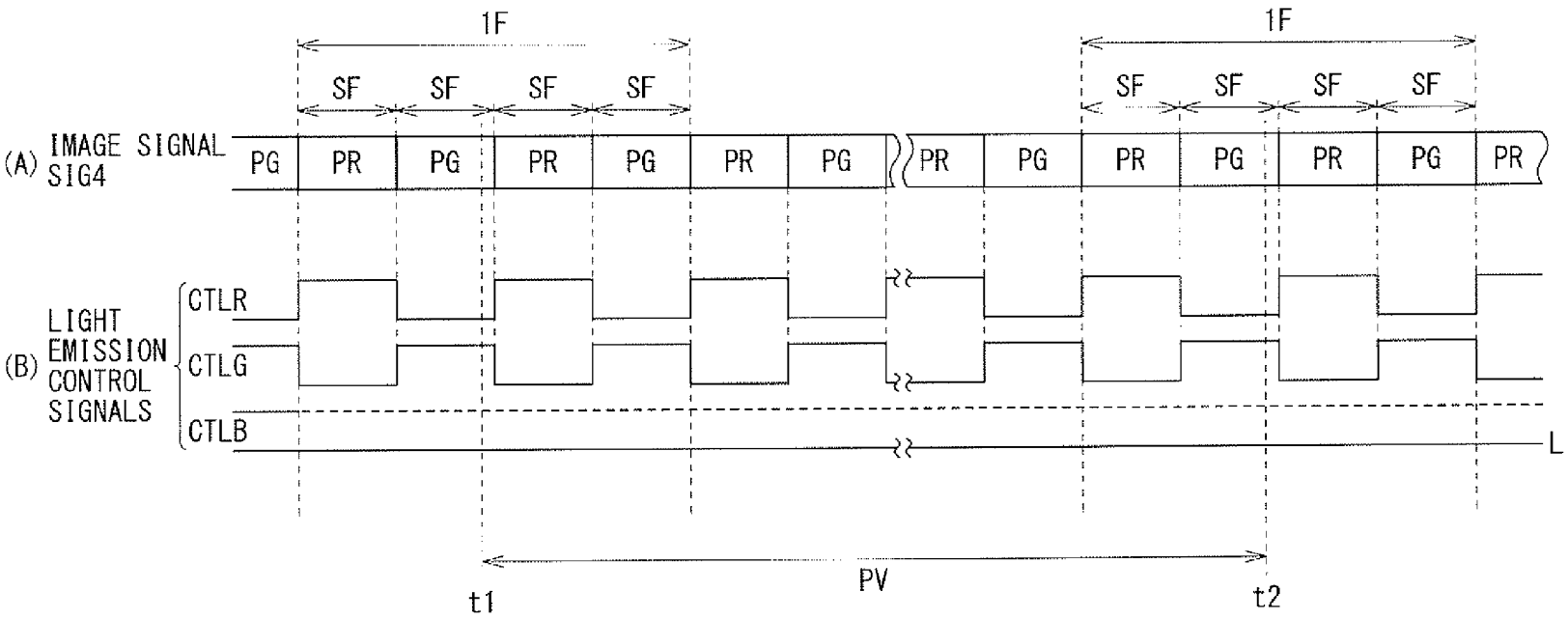

[Fig. 16]
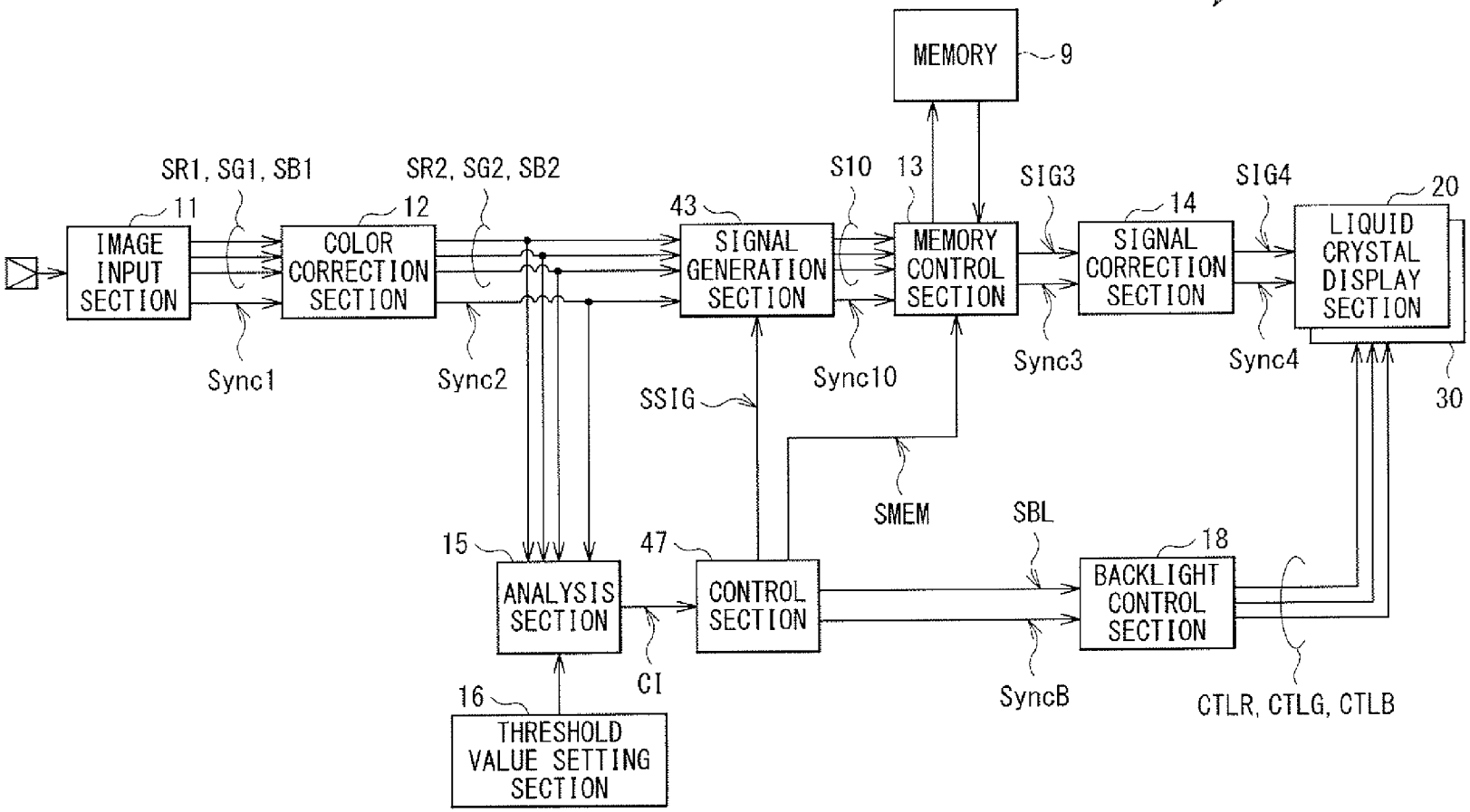

[Fig. 17]
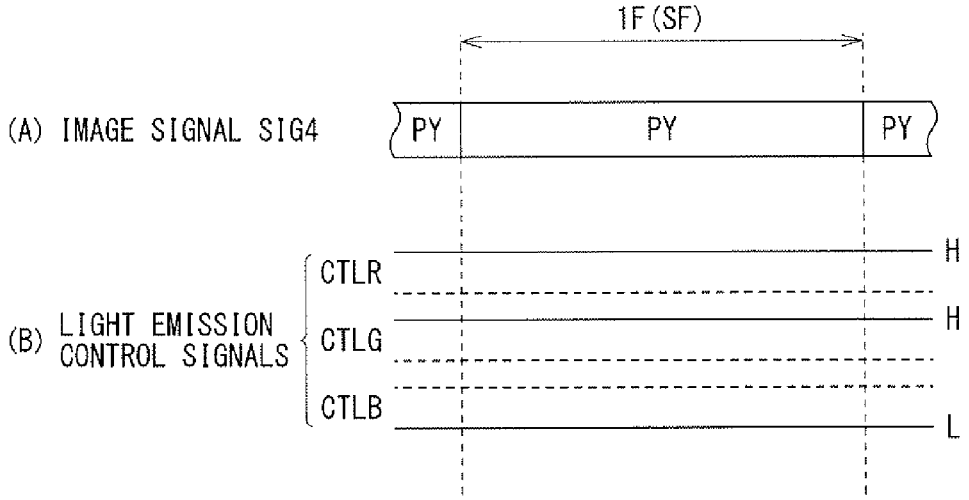
[Fig. 18]
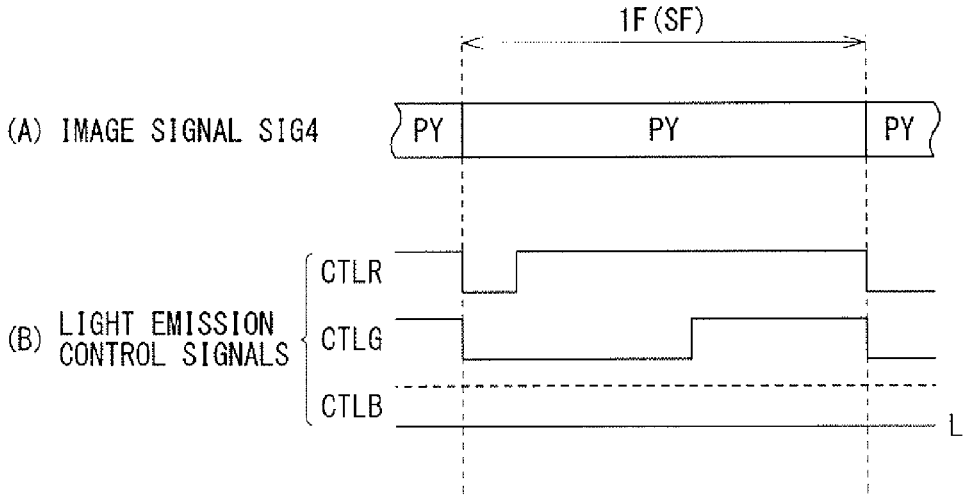
[Fig. 19]
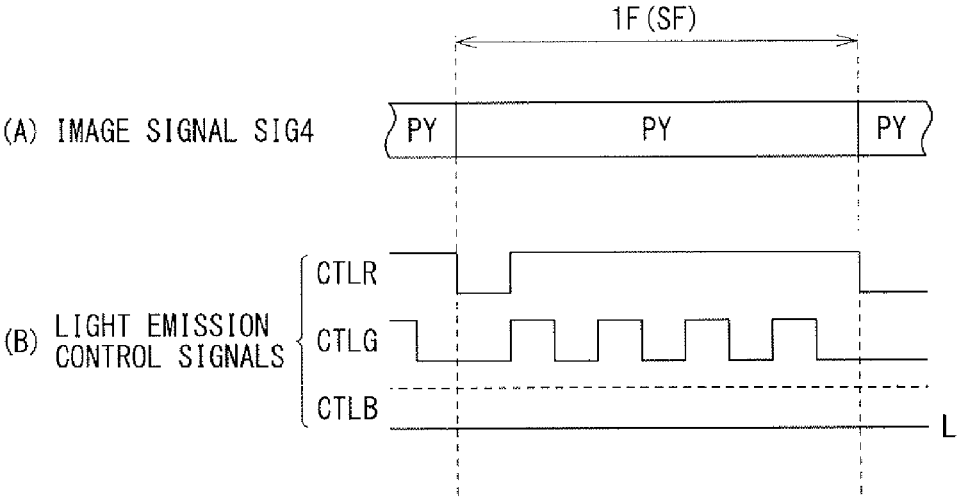

[Fig. 20]
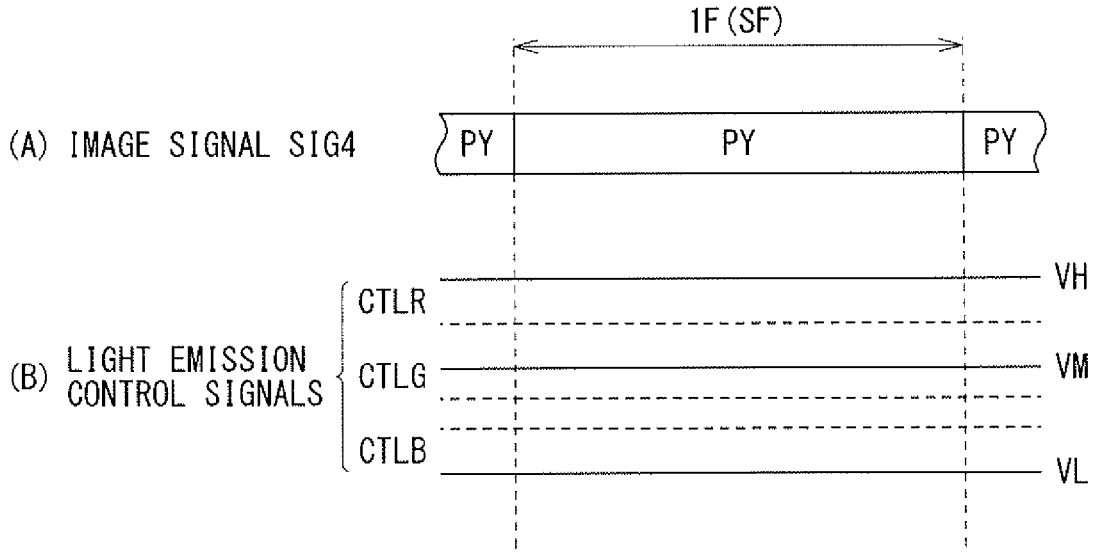

[Fig. 21]
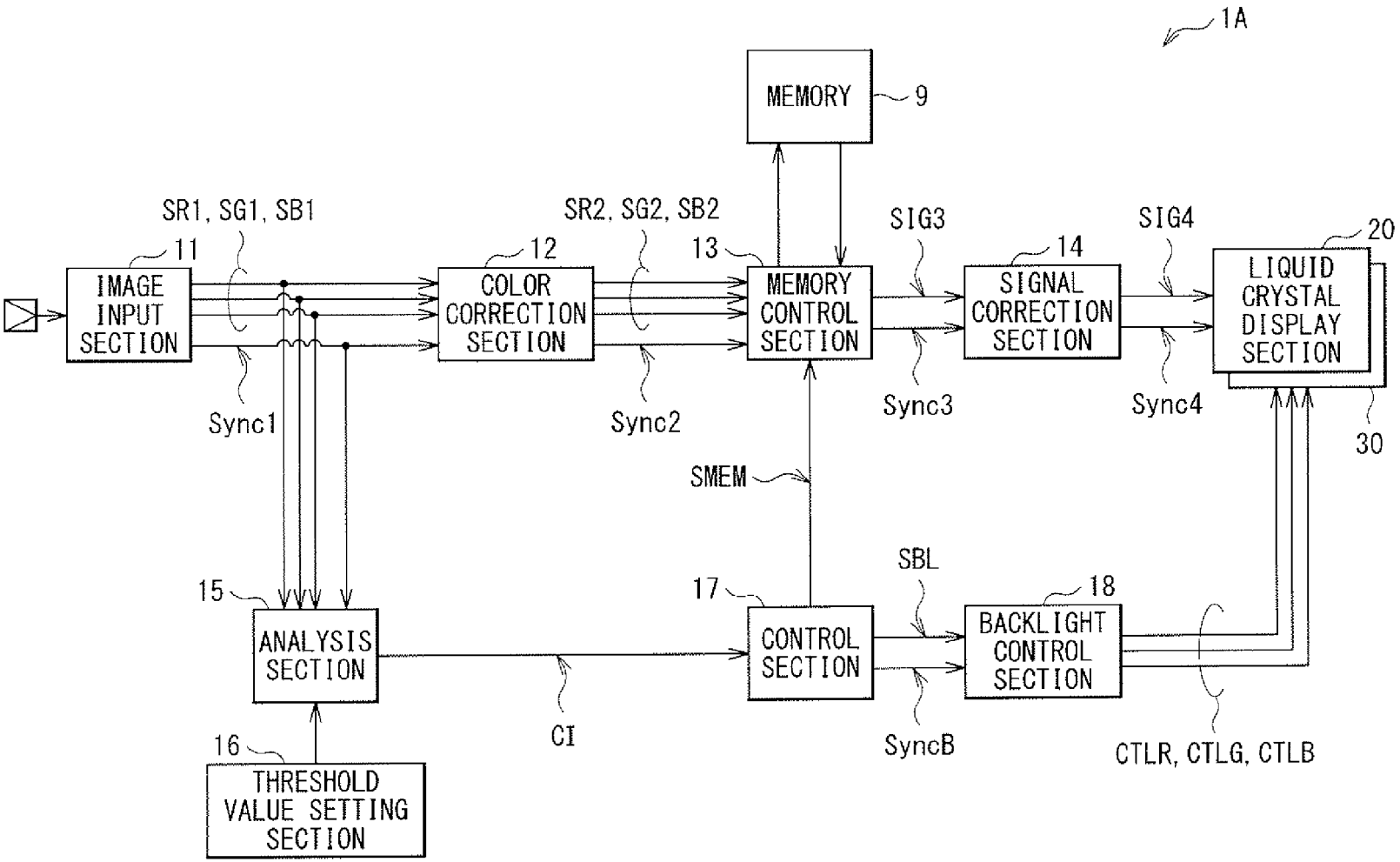

[Fig. 22]
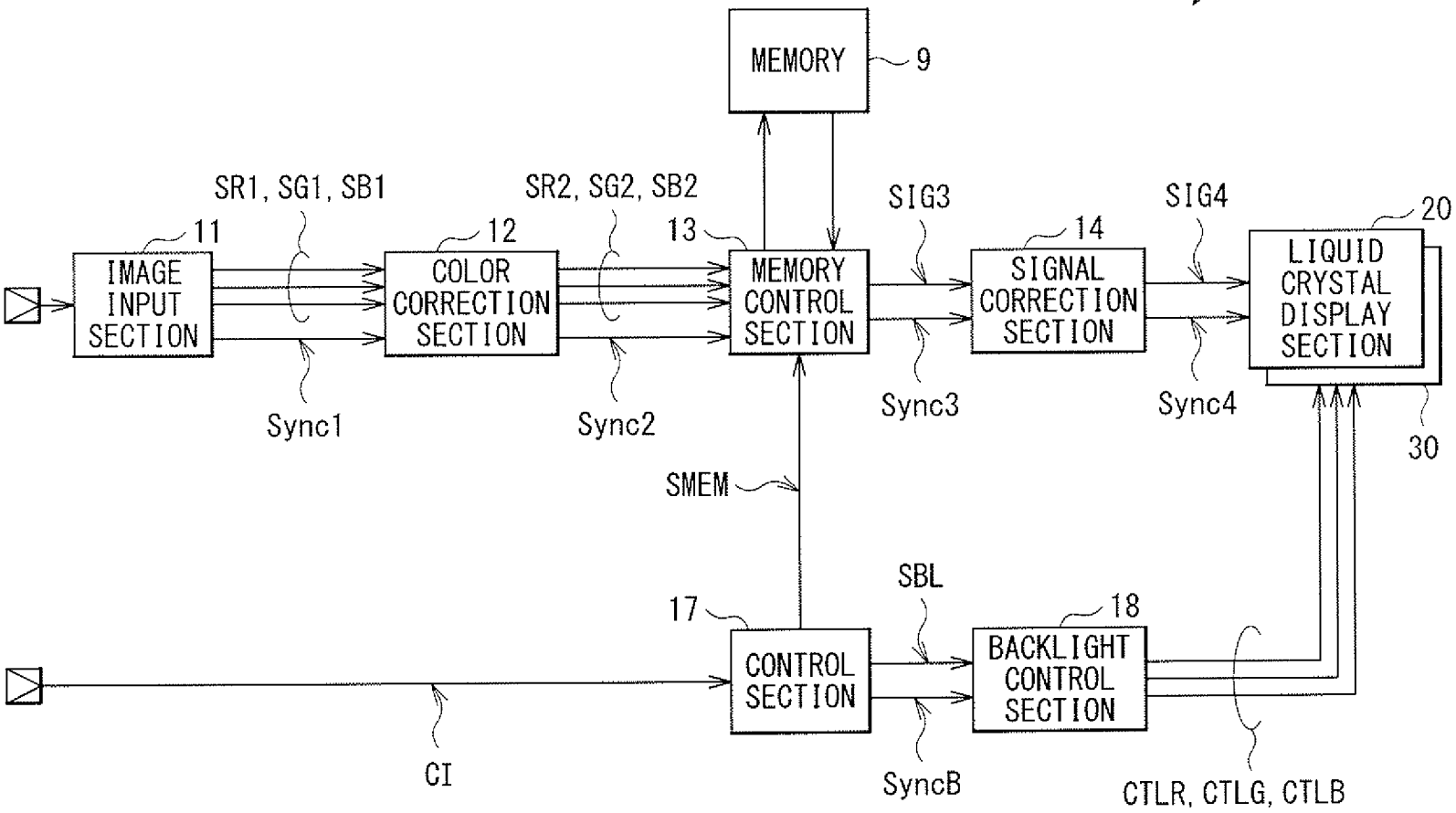

[Fig. 23]
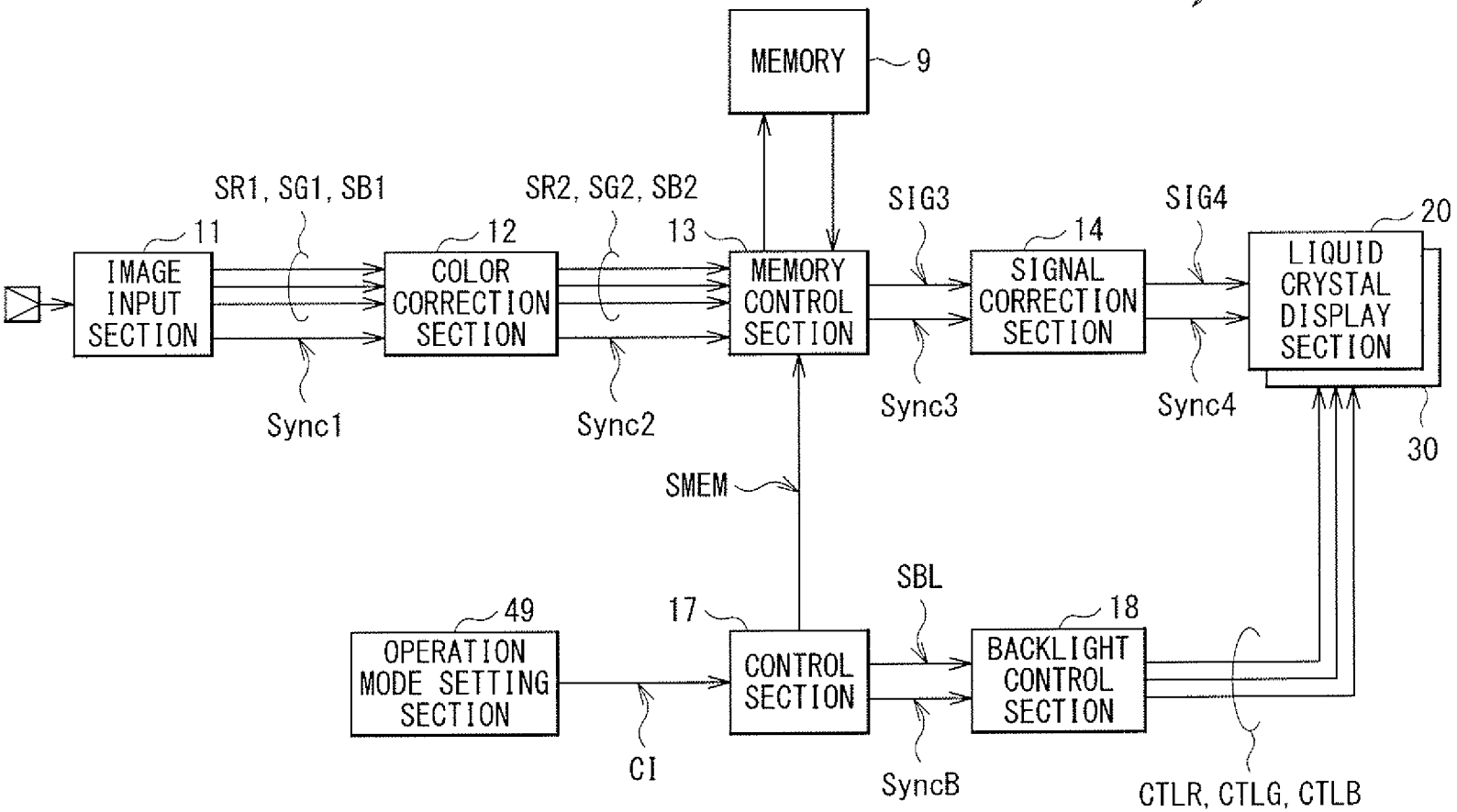

[Fig. 24]
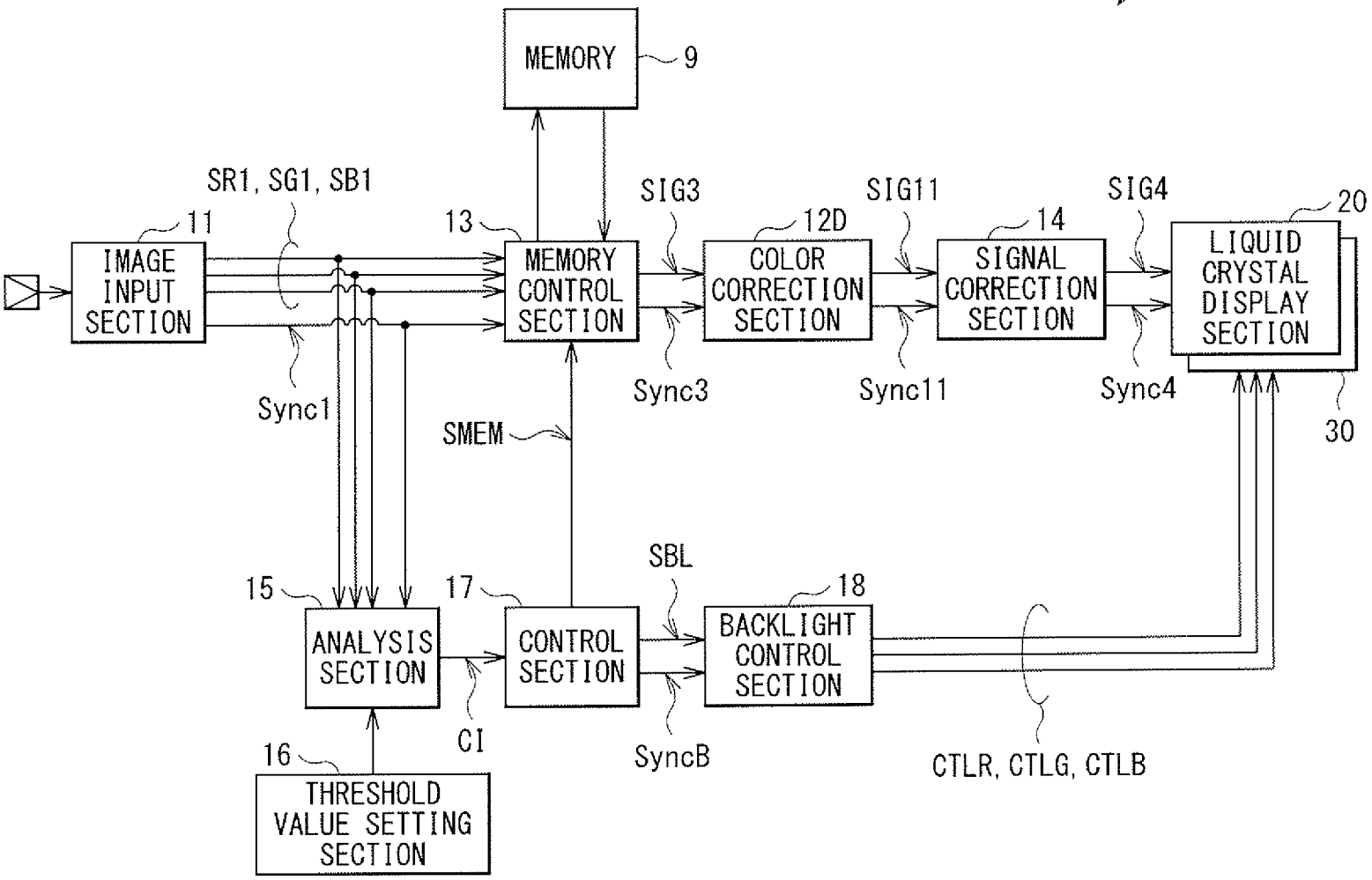

[Fig. 25]
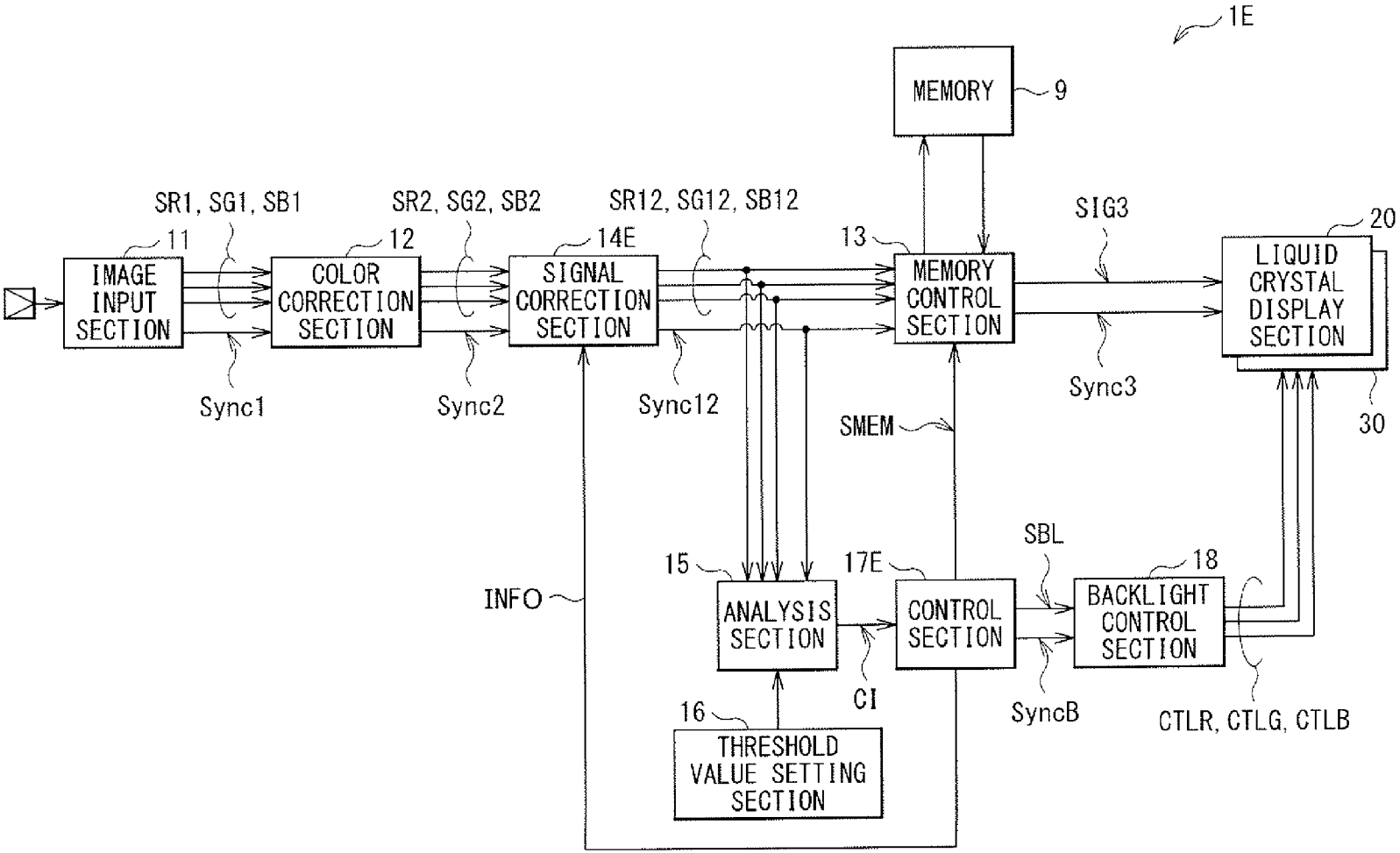

[Fig. 26]
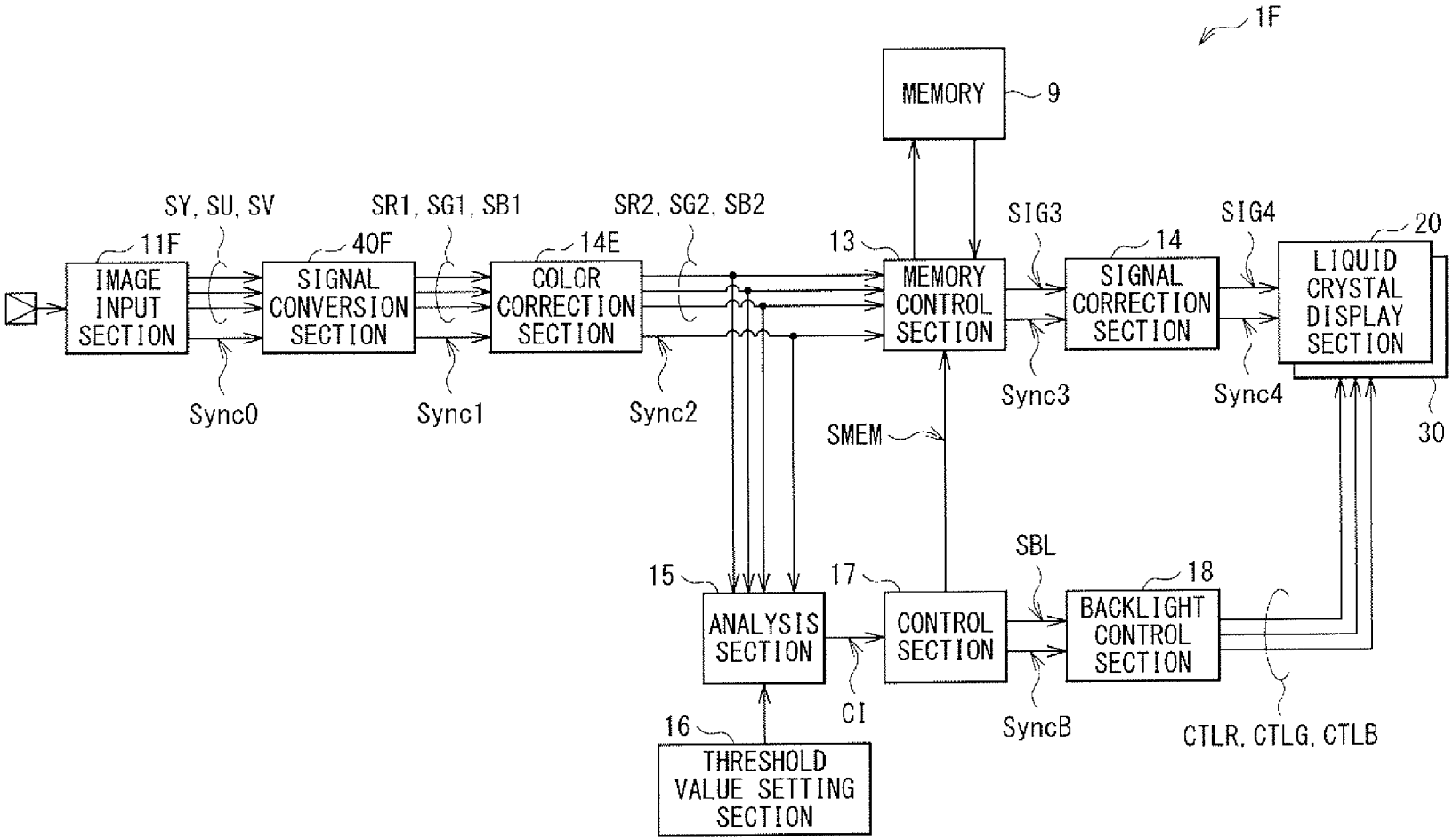

[Fig. 27]
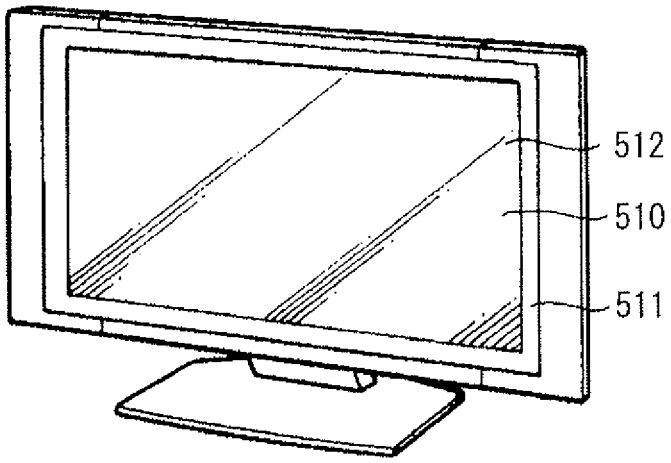
[Fig. 28]
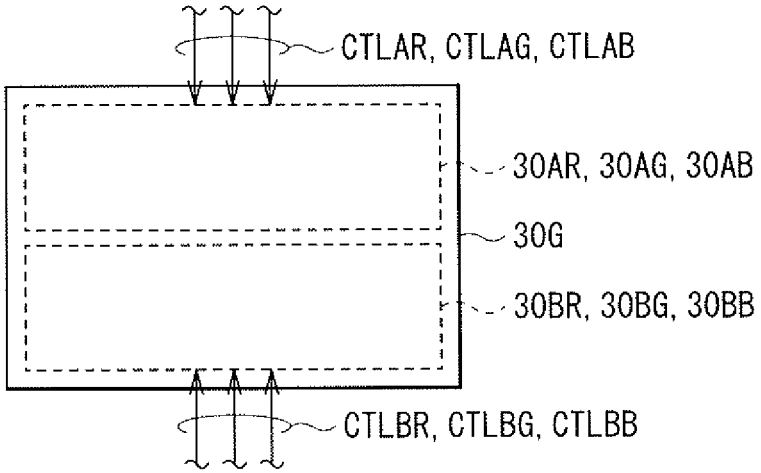
[Fig. 29]
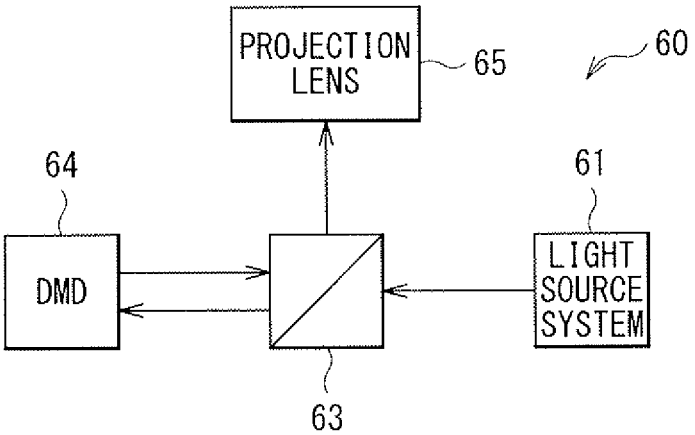

DISPLAY, DISPLAY CONTROL METHOD, DISPLAY CONTROL DEVICE, AND ELECTRONIC APPARATUS

CROSS REFERENCE TO RELATED APPLICATIONS

This application claims the benefit of Japanese priority patent application jp 2013-132443 filed on Jun. 25, 2013, the entire contents of which are incorporated herein by reference.

TECHNICAL FIELD

The present disclosure relates to a display that includes a backlight, a display control method and a display control device used in such a display, and an electronic apparatus including such a display.

BACKGROUND ART

In recent years, a display is applied to various types of electronic apparatus with diversification and multi-functionalization of the electronic apparatus. Specifically, the display is applied to a stationary display such as a television receiver (a television apparatus), a display of portable electronic apparatus (a portable terminal) such as a mobile phone, a projection type display such as a projector, and a wearable display such as a head mounted display.

In general, the display may generate light of any color by combining together light beams of, for example, red (R), green (G), and blue (B) (primary colors) so as to perform display with the light of any color. Specifically, there is a display such as, for example, a liquid crystal display that may include a plurality of pixels each including red, green, and blue sub-pixels so as to perform display using the plurality of pixels. In addition, there is another display such as, for example, a projector that may include red, green, and blue display devices and an optical component such as a prism or the like so as to perform display by overlapping, by the optical component, images that the above-mentioned display devices have generated. Further, there is still another display such as, for example, a so-called field sequential driving type display that may perform display of red, green, and blue in time division (for example, Patent Literatures 1 and 2).

CITATION LIST

Patent Literature

PTL 1: JP 2010-55120A
PTL 2: JP 2009-134156A

SUMMARY

Technical Problem

In general, it is desirable that a display be high in image quality and further improvement in image quality of the display is expected.

It is desirable to provide a display, a display control method, a display control device, and an electronic apparatus that make it possible to improve the image quality.

Solution to Problem

A display according to an embodiment of the present disclosure includes: a predetermined number of light emitting sections configured to emit respective color light beams having respective colors that are different from one another; a light emission control section configured to determine, out of the predetermined number of light emitting sections, one or a plurality of light emitting sections caused to perform light emission in each frame period, and control the light emission of the determined one or the plurality of light emitting sections; and a display section configured to perform display by allowing the color light beams to transmit therethrough or by reflecting the color light beams.

A display device according to an embodiment of the present disclosure is configured to display at least one image, and includes: at least one light emitter configured to emit a plurality of colored light beams, each of the plurality of colored light beams being a respective color different than the others; and a light emission controller configured to determine, based on at least one characteristic of the at least one image, one or more light beams of the plurality of colored light beams to emit in a frame period corresponding to the at least one image.

A display control device according to an embodiment of the present disclosure is configured, for a display section configured to perform display by allowing color light beams to transmit therethrough or by reflecting the color light beams, to determine, out of a predetermined number of light emitting sections configured to emit the respective color light beams having respective colors that are different from one another, one or a plurality of light emitting sections caused to perform light emission in each frame period, and control the light emission of the determined one or the plurality of light emitting sections.

A light emission controller according to an embodiment of the present disclosure is configured to control at least one light emitter, and includes: an analyzer configured to: receive a plurality of image signals, each of the plurality of image signals corresponding to a respective color; create a plurality of comparison results by comparing a plurality of luminance values, based on a respective one of the plurality of image signals, to at least one threshold value; and determine which of the plurality of image signals to display based on the plurality of comparison results; and a controller configured to control the at least one light emitter based on the determination of the analyzer.

A light emitting device according to an embodiment of the present disclosure includes: a plurality of light emitters, each of the plurality of light emitters configured to emit light of a different color; a light emission controller configured to: receive a plurality of image signals, each of the image signals corresponding to a respective one of the plurality of colors; determine at least one of the plurality of light emitters to emit light based on the plurality of image signals; and output a control signal to each of the plurality of light emitters based on the determination of the light emission controller.

Advantageous Effects of Invention

According to the display, the display control method, the display control device, and the electronic apparatus in the above-described embodiments of the present disclosure, out of the predetermined number of light emitting sections, the one or the plurality of light emitting sections that is/are made to emit light in each of the frame periods is/are determined. Therefore, it is possible to improve the image quality.

BRIEF DESCRIPTION OF DRAWINGS

FIG. 1 is a block diagram illustrating one configuration example of a display according to an embodiment of the present disclosure.

FIG. 2 is a block diagram illustrating one configuration example of a liquid crystal display section illustrated in FIG. 1.

FIG. 3 is an explanatory diagram illustrating one configuration example of a backlight illustrated in FIG. 1.

FIG. 4 is a timing chart illustrating one operation example of the display illustrated in FIG. 1.

FIG. 5 is a timing chart illustrating another operational example of the display illustrated in FIG. 1.

FIG. 6 is a timing chart illustrating still another operational example of the display illustrated in FIG. 1.

FIG. 7 is a block diagram illustrating one configuration example of a display according to a comparative example.

FIG. 8 is a timing chart illustrating one operational example of the display illustrated in FIG. 7.

FIG. 9 is a timing chart illustrating another operational example of the display illustrated in FIG. 7.

FIG. 10 is a timing chart illustrating one operational example of a display according to one modification example.

FIG. 11 a timing chart illustrating one operational example of a display according to another modification example.

FIG. 12 a timing chart illustrating one operational example of a display according to still another modification example.

FIG. 13 a timing chart illustrating one operational example of a display according to still another modification example.

FIG. 14 is another timing chart illustrating one operational example of the display illustrated in FIG. 7.

FIG. 15 is a timing chart illustrating one operational example of a display according to still another modification example.

FIG. 16 is a block diagram illustrating one configuration example of a display according to still another modification example.

FIG. 17 is a timing chart illustrating one operational example of the display illustrated in FIG. 16.

FIG. 18 is a timing chart illustrating one operational example of a display according to still another modification example.

FIG. 19 is a timing chart illustrating one operational example of a display according to still another modification example.

FIG. 20 is a timing chart illustrating one operational example of a display according to still another modification example.

FIG. 21 is a block diagram illustrating one configuration example of a display according to still another modification example.

FIG. 22 is a block diagram illustrating one configuration example of a display according to still another modification example.

FIG. 23 is a block diagram illustrating one configuration example of a display according to still another modification example.

FIG. 24 is a block diagram illustrating one configuration example of a display according to still another modification example.

FIG. 25 is a block diagram illustrating one configuration example of a display according to still another modification example.

FIG. 26 is a block diagram illustrating one configuration example of a display according to still another modification example.

FIG. 27 is a perspective view illustrating one external configuration example of a television apparatus to which the display according to one embodiment of the present disclosure has been applied.

FIG. 28 is an explanatory diagram illustrating one configuration example of a backlight according to another modification example.

FIG. 29 is a schematic diagram illustrating one configuration example of a projector to which the display according to one embodiment of the present disclosure has been applied.

DESCRIPTION OF EMBODIMENTS

In the following, some embodiments of the present disclosure will be described with reference to the drawings. It is to be noted that description will be made in the following order.

1. Embodiment
2. Application Example
1. <Embodiment>

CONFIGURATION EXAMPLE

FIG. 1 illustrates one configuration example of a display according to an embodiment of the present disclosure. A display 1 is a display that operates by a so-called field sequential driving scheme. It is to be noted that since a display control method and a display control device according to embodiments of the present disclosure are embodied by the present embodiment, description thereof will be made together with description of the display 1.

The display 1 includes an image input section 11, a color correction section 12, a memory 9, a memory control section 13, a signal correction section 14, a liquid crystal display section 20, an analysis section 15, a threshold value setting section 16, a control section 17, a backlight control section 18, and a backlight 30.

The image input section 11 is an interface used to input an image signal which may be an RGB signal from external equipment such as a PC (Personal Computer) and so forth. The image input section 11 is adapted to output the image signal so input as image signals SR1, SG1, and SB1, and a synchronous signal Sync1 that synchronizes with the image signals SR1, SG1, and SB1. Here, the image signal SR1 is a signal that includes luminance information IR of red (R), the image signal SG1 is a signal that includes luminance information IG of green (G), and the image signal SB1 is a signal that includes luminance information IB of blue (B).

The color correction section 12 is adapted to perform color-related correction such as gamma correction, color irregularity correction and so forth on the basis of the image signals SR1, SG1, and SB1, and the synchronous signal Sync1. The color correction section 12 is configured to generate image signals SR2, SG2, and SB2 by performing such correction as mentioned above, and to generate a synchronous signal Sync2 that synchronizes with the image signals SR2, SG2, and SB2. It is to be noted that although in this example, the color correction section 12 is configured to perform the color-related correction, the color correction section 12 may be configured to perform signal processing other than the color-related correction.

The memory 9 is a so-called frame memory that stores the luminance information IR included in the image signal SR2, the luminance information IG included in the image signal SG2, and the luminance information IB included in the image signal SB2 each by the amount of one frame. The memory 9 is configured such that operations of writing and reading-out the pieces of luminance information IR, IG, and IB into and from the memory 9 are controlled by the memory control section 13.

The memory control section 13 is adapted to control the operations of writing and reading-out the pieces of luminance information IR, IG, and IB into and from the memory 9. Specifically, in the writing operation, the memory control section 13 makes the memory 9 store the pieces of luminance information IR, IG, and IB included in the image signals SR2, SG2, and SB2 on the basis of the image signals SR2, SG2, and SB2, and the synchronous signal Sync2. Thus, for example, the pieces of luminance information IR, IG, and IB corresponding to one frame may be stored into the memory 9. In addition, in the reading-out operation, the memory control section 13 reads out only the luminance information to be displayed out of the pieces of one-frame luminance information IR, IG, and IB from the memory 9 in instructed order on the basis of a memory control signal SMEM as described later. Specifically, the memory control section 13 sequentially reads out any of the one-frame luminance information IR (a red image PR), the one-frame luminance information IG (a green image PG), and the one-frame luminance information IB (a blue image PB) in each subfield SF (described later) on the basis of the memory control signal SMEM. At that time, the memory control section 13 reads out only an image to be displayed out of the red image PR, the green image PG, and the blue image PB. The memory control section 13 is configured to then output one or more of the pieces of luminance information IR, IG, and IB read out from the memory 9 as an image signal SIG3 (a field sequential signal), and to generate and output a synchronous signal Sync3 that synchronizes with the image signal SIG3.

The signal correction section 14 is adapted to perform signal correction on the basis of the image signal SIG3 and the synchronous signal Sync3. Specifically, the signal correction section 14 may be adapted to correct the one or more pieces of luminance information IR, IG, and IB on the basis of, for example, the one or more pieces of luminance information IR, IG, and IB in the plurality of adjacent subfields SF (described later). One example of such correction may include overdrive correction. The signal correction section 14 is configured to generate an image signal SIG4 by performing the above-mentioned correction, and to generate a synchronous signal Sync4 that synchronizes with the image signal SIG4.

The liquid crystal display section 20 is adapted to perform display by driving liquid crystal display elements and modulating light emitted from the backlight 30.

FIG. 2 illustrates one example of a block diagram of the liquid crystal display section 20. The liquid crystal display section 20 includes a timing control section 21, a gate driver 22, a data driver 23, and a pixel array section 24. The timing control section 21 is adapted to control drive timings of the gate driver 22 and the data driver 23 on the basis of the image signal SIG4 and the synchronous signal Sync4, to generate an image signal Sdisp on the basis of the image signal SIG4, and to supply the image signal Sdisp to the data driver 23. The gate driver 22 is adapted to sequentially select and sequentially scan pixels Pix in the pixel array section 24 row by row in accordance with timing control by the timing control section 21. The data driver 23 is adapted to generate a pixel voltage Vpix which is an analog signal by performing D/A (digital/analog) conversion on the basis of the image signal Sdisp and to supply the pixel voltage Vpix to each pixel Pix in the pixel array section 24.

The pixel array section 24 is a section in which the pixels Pix are arranged in a matrix. Each pixel Pix is adapted to perform display in time division on the basis of the pixel voltage Vpix corresponding to the luminance information IR, the pixel voltage Vpix corresponding to the luminance information IG, and the pixel voltage Vpix corresponding to the luminance information IB. That is, each pixel Pix does not include so-called sub-pixels and is configured to perform display of red, green, and blue in time division. It is to be noted that the backlight 30 emits red light, green light, and blue light in time division in synchronization with a displaying operation on the pixel array section 24 as described later. Thus, the display 1 displays the red image PR, the green image PG, and the blue image PB in time division.

Since it is possible to achieve a simple configuration of the display 1 in comparison with a case where the plurality of sub-pixels are included in each pixel Pix in the liquid crystal display section 20 owing to the above-mentioned configuration, it is possible to miniaturize the display 1 and/or to increase the resolution of the display 1. In addition, for example, when the display 1 is applied to a projector, it is possible to reduce the number of liquid crystal display sections to one and to eliminate an optical component in comparison with a case where, for example, red, green and blue liquid crystal display sections and the optical component such as a prism or the like are provided. Therefore, miniaturization of the display 1 is possible and cost saving is possible.

The analysis section 15 is adapted to determine the image to be displayed out of the red image PR, the green image PG, and the blue image PB on the basis of the image signals SR2, SG2, and SB2 and the synchronous signal Sync1 and to output a result of determination as color information CI. Specifically, the analysis section 15 may obtain a histogram concerning to luminance levels of, for example, the image signal SR2 on the basis of the one-frame luminance information IR included in the image signal SR2, and may determine that the red image PR is to be displayed when the luminance levels are equal to or are distributed above a predetermined luminance level (a threshold value Lth). In other words, the analysis section 15 determines that the red image is not to be displayed when all of the luminance levels of the one-frame luminance information IR are less than the threshold value Lth. The analysis section 15 determines whether the green image PG is to be displayed on the basis of the one-frame luminance information IG included in the image signal SG2 and determines whether the blue image PB is to be displayed on the basis of the one-frame luminance information IB included in the image signal SB2 in the same way. Then, the analysis section 15 is configured to output each result of determination so performed as the color information CI.

It is to be noted that although in this example, the analysis section 15 performs determination using the histogram, the way of determining the image to be displayed is not limited to the above-mentioned one, and, for example, the histogram may not be used. For example, the luminance levels of the one-frame luminance information IR included in the image signal SR2 may be monitored, and when there exists a luminance level which is more than or equal to the predetermined luminance level (the threshold value Lth) in the luminance information IR, it may be determined that the red image PR is to be displayed. The same also applies to the green image PG and the blue image PB.

The threshold value setting section 16 is adapted to supply the threshold value Lth to the analysis section 15. The threshold value Lth serves as an evaluation standard when the analysis section 15 determines the image to be displayed out of the red image PR, the green image PG, and the blue image PB. For example, 0 (zero) or a sufficiently low value which is higher than zero may be set as the threshold value Lth. In this case, it may be desirable to set the threshold value Lth in consideration of, for example, characteristics of gamma correction and so forth performed by the color correction section 12. The threshold value Lth may be set (preset) to a predetermined value in advance or a user may optionally set the threshold value Lth.

The control section 17 is adapted to set the subfields SF of the number which is the same as the number of the images to be displayed out of the red image PR, the green image PG, and the blue image PB in a one-frame period on the basis of the color information CI, and to control the display 1 so as to display the images in the respective subfields SF.

Specifically, for example, when the color information CI indicates that all of the red image PR, the green image PG, and the blue image PB are to be displayed, the control section 17 may set three subfields SF in the one-frame period. Then, the control section 17 controls the display 1 so as to display the red image PR, the green image PG, and the blue image PB in this order in the three subfields SF. It is to be noted that although in this example, the images are displayed in order of the red image PR, the green image PG, and the blue image PB, the order is not limited to the above-mentioned one and the images may be displayed in any other order. In addition, for example, when the color information CI indicates that two of the red image PR, the green image PG, and the blue image PB are to be displayed, the control section 17 may set two subfields SF in the one-frame period. Then, the control section 17 may control the display 1 so as to sequentially display these two images in the two subfields SF. In addition, for example, when the color information CI indicates that only one of the red image PR, the green image PG, and the blue image PB is to be displayed, the control section 17 may set one subfield SF in the one-frame period. Then, the control section 17 may control the display 1 so as to display this one image in the one subfield SF.

The control section 17 generates the memory control signal SMEM and a backlight control signal SBL when performing the above-mentioned processing. The memory control signal SMEM is a signal used to control the operation of reading out the pieces of luminance information IR, IG, and IB from the memory 9 in accordance with the subfield(s) SF so set. Specifically, when the red image PR is to be displayed in a certain subfield SF, the control section 17 instructs the memory control section 13 using the memory control signal SMEM so as to read out the one-frame luminance information IR from the memory 9 and to output the read-out luminance information IR as the image signal SIG3. When the green image PG is to be displayed in a certain subfield SF, the control section 17 instructs the memory control section 13 using the memory control signal SMEM so as to read out the one-frame luminance information IG from the memory 9 and to output the read-out luminance information IG as the image signal SIG3 in the same way. In addition, when the blue image PB is to be displayed in a certain subfield SF, the control section 17 instructs the memory control section 13 using the memory control signal SMEM so as to read out the one-frame luminance information IB from the memory 9 and to output the read-out luminance information IB as the image signal SIG3 in the same way.

The backlight control signal SBL is a signal used to control a light emitting operation of the backlight 30 in accordance with the set subfield(s) SF. Specifically, when the red image PR is to be displayed in the certain subfield SF, the control section 17 instructs the backlight control section 18 so as to make a light emitting section 30R (described later) of the backlight 30 emit light using the backlight control signal SBL. When the green image PG is to be displayed in the certain subfield SF, the control section 17 instructs the backlight control section 18 so as to make a light emitting section 30G (described later) of the backlight 30 emit light using the backlight control signal SBL, and when the blue image PB is to be displayed in the certain subfield SF, the control section 17 instructs the backlight control section 18 so as to make a light emitting section 30B (described later) of the backlight 30 emit light using the backlight control signal SBL in the same way. In addition, the control section 17 also has a function of generating and outputting a synchronous signal SyncB that synchronizes with the backlight control signal SBL.

The backlight control section 18 is adapted to generate light emission control signals CTLR, CTLG, and CTLB on the basis of the backlight control signal SBL and the synchronous signal SyncB. The light emission control signal CTLR is a signal used to control light emission of the light emitting section 30R (described later) of the backlight 30, the light emission control signal CTLG is a signal used to control light emission of the light emitting section 30G (described later), and the light emission control signal CTLB is a signal used to control light emission of the light emitting section 30B (described later). The light emission control signals CTLR, CTLG, and CTLB are used to indicate light emission timings, light emission periods, light emission luminances to the respective light emitting sections 30R, 30G, and 30B.

The backlight 30 is adapted to independently emit the red light, the green light, and the blue light on the basis of the light emission control signals CTLR, CTLG, and CTLB and radiate the light so emitted to the liquid crystal display section 20.

FIG. 3 schematically illustrates one configuration example of the backlight 30. The backlight 30 includes the light emitting sections 30R, 30G, and 30B. Each of the light emitting sections 30R, 30G, and 30B may be configured by using, for example, an LED (Light Emitting Diode). The light emitting section 30R performs surface-emission of the red (R) light on the basis of the light emission control signal CTLR, the light emitting section 30G performs surface-emission of the green (G) light on the basis of the light emission control signal CTLG, and the light emitting section 30B performs surface-emission of the blue (B) light on the basis of the light emission control signal CTLB. Thus, it is possible for the light emitting sections 30R, 30G, and 30B to emit light independently from one another.

In the display 1, the image(s) to be displayed out of the red image PR, the green image PG, and the blue image PB is/are determined so as to dynamically change the number of subfields SF in the one-frame period in this way. Thus, the display 1 is configured to make it possible to increase display luminance and to make it possible to reduce power consumption when such an image that only one or two of the red light, the green light, and the blue light is/are used is to be displayed as in the case of a so-called blue screen as described later.

Here, the light emitting sections 30R, 30G, and 30B correspond to one specific example of a "plurality of light emitting sections" in one embodiment of the present disclosure. The analysis section 15, the control section 17, and the backlight control section 18 correspond to one specific example of a "light emission control section" in one embodiment of the present disclosure. The liquid crystal display section 20 corresponds to one specific example of a "display section" in one embodiment of the present disclosure. Each of the pieces of the luminance information IR, IG, and IB corresponds to one specific example of "luminance information" in one embodiment of the present disclosure. The memory control section 13 corresponds to one specific example of a "display control section" in one embodiment of the present disclosure.

(Operations and Functions)

(Outline of General Operation)

First, an outline of the general operation of the display 1 will be described with reference to FIG. 1 and so forth. The image input section 11 inputs an image signal from external equipment. The color correction section 12 performs the color-related correction such as the gamma correction, the color irregularity correction and so forth on the image signal and generates the image signals SR2, SG2, and SB2. The analysis section 15 determines the image to be displayed out of the red image PR, the green image PG, and the blue image PB on the basis of the image signals SR2, SG2, and SB2 and outputs the result of determination as the color information CI. The control section 17 sets the subfields SF of the number which is the same as the number of the images to be displayed out of the red image PR, the green image PG, and the blue image PB in the one-frame period on the basis of the color information CI, and generates the memory control signal SMEM and the backlight control signal SBL. The memory 9 stores the pieces of luminance information IR, IG, and IB included in the image signals SR2, SG2, and SB2. The memory control section 13 controls the operations of writing and reading out the pieces of luminance information IR, IG, and IB into and from the memory 9 on the basis of the memory control signal SMEM and outputs the read-out pieces of luminance information IR, IG, and/or IB as the image signal SIG3. The signal correction section 14 performs signal correction on the image signal SIG3. The liquid crystal display section 20 performs display by driving the liquid crystal display elements and modulating the light radiated from the backlight 30. The backlight control section 18 generates the light emission control signals CTLR, CTLG, and CTLB on the basis of the backlight control signal SBL. The light emitting section 30R of the backlight 30 performs surface-emission of the red light on the basis of the light emission control signal CTLR, the light emitting section 30G performs surface-emission of the green light on the basis of the light emission control signal CTLG, and the light emitting section 30B performs surface-emission of the blue light on the basis of the light emission control signal CTLB.

(Detailed Operations)

In the following, the detailed operations of the display 1 will be described. Here, description will be made by giving the following three cases C1 to C3 as examples. In the case C1, a case where a usual and general image is to be displayed is assumed. Specifically, the case C1 is applied when the pieces of luminance information IR, IG, and IB having luminance levels that are more than or equal to the threshold value Lth are included in the respective pieces of one-frame luminance information IR, IG, and IB. In the case C2, a case where an image in which a black letter or character is arranged against the yellow background is to be displayed is assumed. Specifically, the case C2 is applied when although the pieces of luminance information IR and IG having the luminance levels that are more than or equal to the threshold value Lth are included in the respective pieces of one-frame luminance information IR and IG, the luminance information IB having the luminance levels that are more than or equal to the threshold value Lth is not included in the one-frame luminance information IB. In the case C3, a case where, for example, an image (the so-called blue screen) in which the black letter or character is arranged against the blue background is to be displayed is assumed. Specifically, the case C3 is applied when although the luminance information IB having the luminance levels that are more than or equal to the threshold value Lth is included in the one-frame luminance information IB, the pieces of luminance information IR and IG having the luminance levels that are more than or equal to the threshold value Lth are not included in the respective pieces of one-frame luminance information IR and IG.

(Case C1)

In the case C1, since the pieces of luminance information IR, IG, and IB having the luminance levels that are more than or equal to the threshold value Lth are included in the respective pieces of one-frame luminance information IR, IG, and IB, the analysis section 15 determines that all of the red image PR, the green image PG, and the blue image PB are to be displayed and informs the control section 17 of that determination using the color information CI. In this case, the control section 17 sets three subfields SF in the one-frame period and generates the memory control signal SMEM and the backlight control signal SBL. The memory control section 13 reads out the one-frame luminance information IR (the red image PR), the one-frame luminance information IG (the green image PG), and the one-frame luminance information IB (the blue image PB) in these respective three subfields SF from the memory 9 on the basis of the memory control signal SMEM, and outputs the information so read-out as the image signal SIG3. Then, the signal correction section 14 performs correction on the image signal SIG3 and generates the image signal SIG4. In addition, the backlight control section 18 generates the light emission control signals CTLR, CTLG, and CTLB on the basis of the backlight control signal SBL.

FIG. 4 illustrates one example of the operation of the display 1 in the case C1, in which (A) schematically illustrates an example of the image signal SIG4 and (B) illustrates examples of waveforms of the light emission control signals CTLR, CTLG, and CTLB. In (A) of FIG. 4, "PR" indicates the one-frame luminance information IR (the red image PR), "PG" indicates the one-frame luminance information IG (the green image PG), and "PB" indicates the one-frame luminance information IB (the blue image PB). In addition, in this example, a high level indicates light emission and a low level indicates light extinction in each of the light emission control signals CTLR, CTLG, and CTLB.

In the case C1, the one-frame luminance information IR (the red image PR) is supplied to the liquid crystal display section 20 ((A) of FIG. 4), and the high-level light emission control signal CTLR and the low-level light emission control signals CTLG and CTLB are supplied to the backlight 30 ((B) of FIG. 4) in the first subfield SF in the one-frame period. Thus, the liquid crystal display section 20 displays the red image PR and the light emitting section 30R of the backlight 30 emits the red light. In addition, the one-frame luminance information IG (the green image PG) is supplied to the liquid crystal display section 20 ((A) of FIG. 4), and the high-level light emission control signal CTLG and the low-level light emission control signals CTLR and CTLB are supplied to the backlight 30 ((B) of FIG. 4) in the second subfield SF. Thus, the liquid crystal display section 20 displays the green image PG and the light emitting section 30G of the backlight 30 emits the green light. In addition, the one-frame luminance information IB (the blue image PB) is supplied to the liquid crystal display section 20 ((A) of FIG. 4), and the high-level light emission control signal CTLB and the low-level light emission control signals CTLR and CTLG are supplied to the backlight 30 ((B) of FIG. 4) in the third subfield SF. Thus, the liquid crystal display section 20 displays the blue image PB and the light emitting section 30B of the backlight 30 emits the blue light. The display 1 displays a colored image by displaying the red image PR, the green image PG, and the blue image PB in time division in this way.

(Case C2)

In the case C2, although the pieces of luminance information IR and IG having the luminance levels that are more than or equal to the threshold value Lth are included in the respective pieces of one-frame luminance information IR and IG, the luminance information IB having the luminance levels that are more than or equal to the threshold value Lth is not included in the luminance information IB. Therefore, the analysis section 15 determines that only the red image PR and the green image PG are to be displayed and informs the control section 17 of this determination using the color information CI. In this case, the control section 17 sets two subfields SF in the one-frame period and generates the memory control signal SMEM and the backlight control signal SBL. The memory control section 13 reads out the one-frame luminance information IR (the red image PR) and the one-frame luminance information IG (the green image PG) from the memory 9 in the respective two subfields SF on the basis of the memory control signal SMEM, and outputs the information so read-out as the image signal SIG3. That is, the memory control section 13 does not read out the one-frame luminance information IB (the blue image PB) from the memory 9. Then, the signal correction section 14 performs correction on the image signal SIG3 and generates the image signal SIG4. In addition, the backlight control section 18 generates the light emission control signals CTLR, CTLG, and CTLB on the basis of the backlight control signal SBL.

FIG. 5 illustrates one example of the operation of the display 1 in the case C2, in which (A) schematically illustrates one example of the image signal SIG4 and (B) illustrates examples of the waveforms of the light emission control signals CTLR, CTLG, and CTLB. In the case C2, the one-frame luminance information IR (the red image PR) is supplied to the liquid crystal display section 20 ((A) of FIG. 5) and the high-level light emission control signal CTLR and the low-level light emission control signals CTLG and CTLB are supplied to the backlight 30 ((B) of FIG. 5) in the first subfield SF in the one-frame period. Thus, the liquid crystal display section 20 displays the red image PR and the light emitting section 30R of the backlight 30 emits the red light. In addition, the one-frame luminance information IG (the green image PG) is supplied to the liquid crystal display section 20 ((A) of FIG. 5) and the high-level light emission control signal CTLG and the low-level light emission control signals CTLR and CTLB are supplied to the backlight 30 ((B) of FIG. 5) in the second subfield SF. Thus, the liquid crystal display section 20 displays the green image PG and the light emitting section 30G of the backlight 30 emits the green light. The display 1 displays a yellow image by displaying the red image PR and the green image PG, in time division in this way. That is, since all of the luminance levels of the one-frame luminance information IB are less than the threshold value Lth, the analysis section 15 determines that display of the blue image PB is not necessary and the display 1 displays the two images (the red image PR and the green image PG) excluding the blue image PB in time division.

(Case C3)

In the case C3, although the luminance information IB having the luminance levels that are more than or equal to the threshold value Lth is included in the one-frame luminance information IB, the pieces of luminance information IR and IG having the luminance values that are more than or equal to the threshold value Lth are not included in the respective pieces of one-frame luminance information IR and IG. Therefore, the analysis section 15 determines that only the blue image PB is to be displayed and informs the control section 17 of this determination using the color information CI. In this case, the control section 17 sets one subfield SF in the one-frame period and generates the memory control signal SMEM and the backlight control signal SBL. The memory control section 13 reads out the one-frame luminance information IB (the blue image PB) from the memory 9 in the one subfield SF and outputs the information so read-out as the image signal SIG3. That is, the memory control section 13 does not read out the one-frame luminance information IR (the red image PR) and the one-frame luminance information IG (the green image PG) from the memory 9. Then, the signal correction section 14 performs correction on the image signal SIG3 and generates the image signal SIG4. In addition, the backlight control section 18 generates the light emission control signals CTLR, CTLG, and CTLB on the basis of the backlight control signal SBL.

FIG. 6 illustrates one example of the operation of the display 1 in the case C3, in which (A) schematically illustrates one example of the image signal SIG4 and (B) illustrates examples of the waveforms of the light emission control signals CTLR, CTLG, and CTLB. In the case C3, the one-frame luminance information IB (the blue image PB) is supplied to the liquid crystal display section 20 ((A) of FIG. 6) and the high-level light emission control signal CTLB and the low-level light emission control signals CTLR and CTLG are supplied to the backlight 30 ((B) of FIG. 6) in the one-frame period (the subfield SF). Thus, the liquid crystal display section 20 displays the blue image PB and the light emitting section 30B of the backlight 30 emits the blue light. The display 1 displays only the blue image PB in this way. That is, since all of the luminance levels of each of the pieces of one-frame luminance information IR and IG are less than the threshold value Lth, the analysis section 15 determines that display of the red image PR and the green image PG is not necessary and the display 1 displays only the blue image PB.

In the display 1, the analysis section 15 determines the image(s) to be displayed out of the red image PR, the green image PG, and the blue image PB in this way. Then, the control section 17 dynamically changes the number of the subfields SF in the one-frame period in accordance with the number of images to be displayed out of the red image PR, the green image PG, and the blue image PB on the basis of a result of the above-mentioned determination, and controls the display 1 so as to display the images in the respective subfields SF. In other words, in the display 1, whether the image that has been supplied is the usual image (for example, the case C1) or the image that only one or two of the red light, the green light, and the blue light is/are used as in the case of the so-called blue screen (for example, the case C2 or C3) is determined, and in the latter case, the number of the subfields SF in the one-frame period is reduced. Thus, it is possible to increase the display luminance of the display 1 and it is also possible to reduce the power consumption when the image that only one or two of the red light, the green light, and the blue light is/are used is to be displayed as described below in comparison with a comparative example.

COMPARATIVE EXAMPLE

In the following, a display 1R according to the comparative example will be described. The display 1R is adapted to constantly set three subfields SF in the one-frame period.

FIG. 7 illustrates one configuration example of the display 1R according to the comparative example. The display 1R includes a control section 13R. The control section 13R is adapted to control the operations of writing and reading out the pieces of luminance information IR, IG, and/or IB into and from the memory 9 on the basis of the image signals SR2, SG2, and SB2, and the synchronous signal Sync2, and to output the read-out pieces of luminance information IR, IG, and/or IB as the image signal SIG3. Specifically, the control section 13R constantly sets the three subfields SF in the one-frame period, reads out the one-frame luminance information IR (the red image PR), the one-frame luminance information IG (the green image PG), and the one-frame luminance information IB (the blue image PB) in the respective three subfields SF, and outputs the read-out information as the image signal SIG3. In addition, the control section 13R also has a function of generating the light emission control signals CTLR, CTLG, and CTLB that synchronize with display of the red image PR, the green image PG, and the blue image PB.

FIG. 8 illustrates one example of the operation of the display 1R in the case C2 and FIG. 9 illustrates one example of the operation of the display 1R in the case C3. In each of FIGS. 8 and 9, (A) schematically illustrates one example of the image signal SIG4 and (B) illustrates examples of the waveforms of the light emission control signals CTLR, CTLG, and CTLB. It is to be noted that the operation of the display 1R in the case C1 is the same as that in the case (FIG. 4) of the present embodiment. The control section 13R sets the three subfields SF in the one-frame period irrespective of the cases C1 to C3 in this way. Then, the liquid crystal display section 20 displays the red image PR and the light emitting section 30R of the backlight 30 emits the red light in the first subfield SF in the one-frame period, the liquid crystal display section 20 displays the green image PG and the light emitting section 30G of the backlight 30 emits the green light in the second subfield SF, and the liquid crystal display section 20 displays the blue image PB and the light emitting section 30B of the backlight 30 emits the blue light in the third subfield SF.

However, since in the case C2, all of the luminance levels of the one-frame luminance information IB are less than the threshold value Lth, the blue image PB is displayed as a near black blue image. Therefore, in the example in FIG. 8, although the light emitting section 30B emits light, the display 1R performs black display and therefore a period that hardly contributes to display is created in the third subfield SF. In the case C3, since all of the luminance levels of each of the pieces of one-frame luminance information IR and IG are less than the threshold value Lth, both of the red image PR and the green image PG are displayed as near black images similarly. Therefore, in the example in FIG. 9, although the light emitting sections 30R and 30G emit light, the display 1R performs the black display and therefore the period that hardly contributes to display is created in each of the first and second subfields SF.

Since in the display 1R according to the comparative example, the number of subfields SF in the one-frame period has been fixed to three as described above, the period that hardly contributes to display is created when the image in which only one or two of the red light, the green light, and the blue light is/are used is to be displayed as in the case of the so-called blue screen. In such a period, the power consumption may possibly be wasted due to light emission of the backlight 30 (the light emitting sections 30R, 30G, and 30B).

On the other hand, the display 1 according to the present embodiment is configured such that the image(s) to be displayed out of the red image PR, the green image PG, and the blue image PB is/are determined and the number of subfields SF in the one-frame period is dynamically changed depending on the image(s) to be displayed. Thus, since it is possible to omit the period that does not contribute to display in the display 1, it is possible to increase the display luminance of the display 1 and it is also possible to suppress waste of the power consumption. That is, for example, as to the case C2, the example in FIG. 5 according to the embodiment may correspond to an example in which the light emission period (the third subfield SF) of the light emitting section 30B is omitted and the light emission periods (the first and second subfields SF) of the light emitting sections 30R and 30G are lengthened in FIG. 8 according to the comparative example. Thus, it is possible to increase the display luminance of the display 1 and it is also possible to suppress waste of the power consumption caused by light emission of the light emitting section 30B. For example, as for the case C3, the example in FIG. 6 according to the present embodiment may correspond to an example in which the light emission periods (the first and second subfields SF) of the light emitting sections 30R and 30G are omitted and the light emission period (the third subfield SF) of the light emitting section 30B is lengthened in FIG. 9 according to the comparative example in the same way. Thus, it is possible to increase the display luminance and the image quality of the display 1 and it is also possible to suppress waste of the power consumption caused by light emission of the light emitting sections 30R and 30G.

In addition, since in the display 1R according to the comparative example, the three subfields are constantly set in the one-frame period, it is necessary for the liquid crystal display section 20 to perform scan driving three times in the one-frame period constantly and therefore the power consumption may possibly be increased.

On the other hand, since in the display 1 according to the present embodiment, the number of subfields SF in the one-frame period is dynamically changed, it is possible to reduce the number of times of performing scan driving by the liquid crystal display section 20 depending on the image(s) to be displayed and therefore it is possible to reduce the power consumption.

(Effects)

Since in the present embodiment, the number of subfields SF in the one-frame period is dynamically changed as described above, it is possible to increase the display luminance and the image quality of the display and it is also possible to reduce the power consumption when such display that only one or two of the red light, the green light, and the blue light is/are used is to be performed as in the case of the blue screen.

Modification Example 1

Although the light emission control signals CTLR, CTLG, and CTLB have been made to transit at a start timing of each subfield SF in the above-mentioned embodiment, the present disclosure is not limited to this configuration. The backlight control section 18 may be configured to set a start timing and a finish timing of each pulse (a pulse phase and a pulse width) in each of the light emission control signals CTLR, CTLG, and CTLB, for example, as illustrated in FIG. 10. In the example illustrated in FIG. 10, the timings are set such that the pulse widths of the light emission control signals CTLR, CTLG, and CTLB are made different from one another. It is possible to make each of the light emitting sections 30R, 30G, and 30B emit light at a timing that liquid crystal response and so forth of the liquid crystal display section 20 are taken into account, by configuring so as to set the start timing and the finish timing of each pulse as described above.

Modification Example 2

Although in the above-mentioned embodiment, one subfield SF has been set in the one-frame period when one of the red image PR, the green image PG, and the blue image PB is to be displayed (for example, the case C3), the present disclosure is not limited to this configuration. Alternatively, for example, as illustrated in FIG. 11, a plurality (in this example, three) of the subfields SF may be set in the one-frame period and the same image (in this example, the blue image PB) may be repetitively displayed. Thus, since scan driving is performed a plurality of times (in this example, three times) in the one-frame period in the liquid crystal display section 20, it is possible to reduce degradation of image quality caused by leakage in a transistor of the pixel Pix. Even in this case, a configuration that allows setting of the start timing and the finish timing (the pulse phase and the pulse width) of each pulse in each of the light emission control signals CTLR, CTLG, and CTLB may be possible as illustrated in FIG. 12.

Modification Example 3

Although, in the above-mentioned embodiment, the two subfields have been set in the one-frame period when two of the red image PR, the green image PG, and the blue image PB are to be displayed (for example, the case C2), the present disclosure is not limited to this configuration. Alternatively, three or more subfields SF may be set in the one-frame period or one subfield SF may be set in the one-frame period. In the following, the present modification example will be described in detail by giving several examples thereof.

First, a display 2 according to the present modification example will be described. The display 2 is adapted to set four subfields SF in the one-frame period in the case C2.

FIG. 13 illustrates one example of the operation of the display 2 in the case C2, in which (A) schematically illustrates one example of the image signal SIG4 and (B) illustrates examples of the waveforms of the light emission control signals CTLR, CTLG, and CTLB. The display 2 sets the four subfields SF in the one-frame period in the case C2. In the display 2, the one-frame luminance information IR (the red image PR) is supplied to the liquid crystal display section 20 ((A) of FIG. 13) and the high-level light emission control signal CTLR and the low-level light emission control signals CTLG and CTLB are supplied to the backlight 30 ((B) of FIG. 13) in the first subfield SF. Thus, the liquid crystal display section 20 displays the red image PR and the light emitting section 30R of the backlight 30 emits the red light. Then, the one-frame luminance information IG (the green image PG) is supplied to the liquid crystal display section 20 ((A) of FIG. 13) and the high-level light emission control signal CTLG and the low-level light emission control signals CTLR and CTLB are supplied to the backlight 30 ((B) of FIG. 13) in the second subfield SF. Thus, the liquid crystal display section 20 displays the green image PG and the light emitting section 30G of the backlight 30 emits the green light. Then, the one-frame luminance information IR (the red image PR) which is the same as the information in the first subfield SF is again supplied to the liquid crystal display section 20 ((A) of FIG. 13) and the high-level light emission control signal CTLR and the low-level light emission control signals CTLG and CTLB are supplied to the backlight 30 ((B) of FIG. 13) in the third subfield SF. Thus, the liquid crystal display section 20 displays the red image PR and the light emitting section 30R of the backlight 30 emits the red light. Then, the one-frame luminance information IG (the green image PG) which is the same as the information in the second subfield SF is again supplied to the liquid crystal display section 20 ((A) of FIG. 13) and the high-level light emission control signal CTLG and the low-level light emission control signals CTLR and CTLB are supplied to the backlight ((B) of FIG. 13) in the fourth subfield SF. Thus, the liquid crystal display section 20 displays the green image PG and the light emitting section 30G of the backlight 30 emits the green light.

The display 2 displays the red image PR and the green image PG two times per image in time division in the one-frame period in this way. For example, it is possible to reduce the probability that a viewer feels as if the image quality has been reduced when the viewer has not viewed a display screen for a very short period of time by blinking eyes as described below in comparison with the display 1R according to the comparative example.

FIG. 14 illustrates one example of the operation of the display 1R according to the comparative example in the case C2 and FIG. 15 illustrates one example of the operation of the display 2 according to the modification example in the case C2. In each of FIG. 14 and FIG. 15, (A) schematically illustrates one example of the image signal SIG4 and (B) illustrates examples of the waveforms of the light emission control signals CTLR, CTLG, and CTLB.

In the display 1R according to the comparative example, when the viewer has not observed the display screen of the display 1R in a very short period PV from timings t1 to t2, the viewer may possibly see a color which is different from the original color immediately before the timing t1 and immediately after the timing t2 as illustrated in FIG. 14. Specifically, in this example, the viewer may possibly recognize that a somewhat reddish image is displayed on the display screen immediately before the timing t1 and may possibly recognize that a somewhat greenish image is displayed on the display screen immediately after the timing t2. In the display 1R according to the comparative example, the viewer may possibly feel that the image quality has been reduced due to occurrence of so-called "color breakup" as described above.

On the other hand, in the display 2 according to the present modification example, it is possible for the viewer to see the color which is almost the same as the original color even immediately before the timing t1 and immediately after the timing t2 as illustrated in FIG. 15. That is, since in the display 2, many subfields SF are set in the one-frame period, it is possible to reduce the possibility of occurrence of the color breakup and therefore it is possible to increase the image quality.

In the following, a display 3 according to the present modification example will be described. The display 3 is adapted to set one subfield SF in the one-frame period and to make two of the light emitting sections 30R, 30G, and 30B emit light.

FIG. 16 illustrates one configuration example of the display 3 according to the present modification example. The display 3 includes a control section 47 and a signal generation section 43.

The control section 47 is adapted to set one or the plurality of subfields SF in the one-frame period on the basis of the color information CI and to control the display 3 so as to display each image in each of the subfields SF as in the control section 17 according to the above-mentioned embodiment. At that time, when the color information CI indicates that two of the red image PR, the green image PG, and the blue image PB are to be displayed, the control section 47 sets one subfield SF in the one-frame period. Then, in this case, the control section 47 generates a control signal SSIG indicating that the two images correspond to which images of the red image PR, the green image PG, and the blue image PB. It is to be noted that when the color information CI indicates that all of the red image PR, the green image PG, and the blue image PB are to be displayed (for example, the case C1) or indicates that one of these images is to be displayed (for example, the case C3), the control section 47 operates in the same way as the control section 17.

The signal generation section 43 is adapted to generate an image signal S10 and a synchronous signal Sync10 that synchronizes with the image signal S10 on the basis of the image signals SR2, SG2, and SB2, the synchronous signal Sync2, and the control signal SSIG.

At that time, when two of the red image PR, the green image PG, and the blue image PB are to be displayed (for example, the case C2), the signal generation section 43 generates an image of a combination color of those two images on the basis of the control signal SSIG and outputs the image so generated as the image signal S10. Specifically, for example, when the control signal SSIG indicates that the red image PR and the green image PG are to be displayed, the signal generation section 43 may generate a yellow image PY and may output the image signal S10 that includes luminance information IY of yellow (Y). In addition, for example, when the control signal SSIG indicates that the green image PG and the blue image PB are to be displayed, the signal generation section 43 may generate a cyan image PC and may output the image signal S10 that includes luminance information IC of cyan (C). In addition, for example, when the control signal SSIG indicates that the red image PR and the blue image PB are to be displayed, the signal generation section 43 may generate a magenta image PM and may output the image signal S10 that includes luminance information IM of magenta (M). Here, for example, RGB/YUV conversion may be performed on the basis of the pieces of luminance information IR, IG, and IB included in the image signals SR2, SG2, and SB2 and a Y component in the YUV signal so converted may be used as the pieces of luminance information IY, IC, and IM.

It is to be noted that when all of the red image PR, the green image PG, and the blue image PB are to be displayed (for example, the case C1) or when one of these images is to be displayed (for example, the case C3), the signal generation section 43 may not generate any image and may output the image signals SR2, SG2, and SB2 as the image signal S10 as they are.

For example, when the color information CI indicates that two of the red image PR, the green image PG, and the blue image PB are to be displayed (for example, the case C2), the control section 47 may set one subfield SF in the one-frame period and may generate the control signal SSIG owing to the above-mentioned configuration. In addition, the signal generation section 43 may generate an image of a combination color of these two images and may output the image as the image signal S10 on the basis of the control signal SSIG.

Here, the signal generation section 43 corresponds to one specific example of a "luminance information generation section" in one embodiment of the present disclosure.

FIG. 17 illustrates one example of the operation of the display 3 in the case C2, in which (A) schematically illustrates one example of the image signal SIG4 and (B) illustrates examples of the waveforms of the light emission control signals CTLR, CTLG, and CTLB. In this case, since the analysis section 15 determines that two images, i.e., the red image PR and the green image PG are to be displayed, the signal generation section 43 generates the yellow image PY. Then, luminance information that configures the yellow image PY is supplied to the liquid crystal display section 20 ((A) of FIG. 17) and the high-level light emission signals CTLR and CTLG and the low-level light emission control signal CTLB are supplied to the backlight 30 ((B) of FIG. 17) in the one-frame period (the subfield SF). Thus, the liquid crystal display section displays the yellow image PY and the backlight 30 emits yellow light as red and green combination light.

It is possible to increase the display luminance of the display 3 and it is also possible to reduce the power consumption by configuring as mentioned above, for example, not only when an image configured by one of red, green, and blue (the primary colors) is to be displayed but also when an image configured by a combination color of the primary colors is to be displayed.

Although in this example, the light emission control signals CTLR, CTLG, and CTLB have been made to be maintained at the high levels or the low levels over the period of the subfield SF, the present disclosure is not limited to this configuration. Alternatively, the start timing and the finish timing (the pulse phase and the pulse width) of each pulse in each of the light emission control signals CTLR, CTLG, and CTLB may be changed, for example, as illustrated in FIG. 18. Thus, it is possible to change a combination ratio among the red light that the light emitting section 30R emits, the green light that the light emitting section 30G emits, and the blue light that the light emitting section 30B emits, and therefore it is possible to adjust the color that the backlight 30 emits. In the above-mentioned case, this combination ratio may be changed, for example, using the pieces of luminance information IR, IG, and IB. Thus, it is possible for the backlight 30 to emit light in a color according to the pieces of luminance information IR, IG, and IB. In addition, one or more of the light emission control signals CTLR, CTLG, and CTLB may be configured by a plurality of pulses as illustrated in FIG. 19. In this case, it is possible to reduce the probability that color breakup occurs and therefore it is possible to increase the image quality as in the case of the display 2 according to the above-mentioned present modification example. It is to be noted that although the combination ratio among the red light, the green light, and the blue light has been adjusted by changing the respective pulse widths in the above-mentioned examples, the present disclosure is not limited to this configuration. Alternatively, a color of the light that the backlight 30 emits may be adjusted by changing the emission luminances of the respective light emitting sections 30R, 30G, and 30B by changing the signal levels of the light emission control signals CTLR, CTLG, and CTLB, for example, as illustrated in FIG. 20. In this example, the emission luminance of the light emitting section 30G is made lower than the emission luminance of the light emitting section 30R by supplying a voltage VH to the light emitting section 30R and supplying a voltage VM which is lower than the voltage VH to the light emitting section 30G. It is to be noted that although in this example, the emission luminances of the light emitting sections 30R, 30G, and 30B have been adjusted by supplying voltages, the present disclosure is not limited to this. Alternatively, the emission luminances may be adjusted, for example, by supplying currents to the light emitting sections.

It is to be noted that although in the display 3, one subfield SF has been set in the one-frame period and two of the light emitting sections 30R, 30G, and 30B have been made to emit light in the case C2, the present disclosure is not limited to this. Alternatively, for example, one subfield SF may be set in the one-frame period and all of the light emitting sections 30R, 30G, and 30B may be made to emit light in the case C1.

Modification Example 4

Although, in the above-mentioned embodiment, the analysis section 15 has determined the image(s) to be displayed out of the red image PR, the green image PG, and the blue image PB on the basis of the image signals SR2, SG2, and SB2 and the synchronous signal Sync2 which are the output signals from the color correction section 12, the present disclosure is not limited to this configuration. For example, as in a display 1A illustrated in FIG. 21, the analysis section 15 may perform this processing (image determination) on the basis of the image signals SR1, SG1, and SB1 and the synchronous signal Sync1 which are the input signals into the color correction section 12.

Modification Example 5

Although in the above-mentioned embodiment, the display 1 includes the analysis section 15, the present disclosure is not limited to this configuration. Alternatively, the analysis section 15 may not be included when it is possible to supply the color signal (the color information) CI from the outside, for example, as in a display 1B illustrated in FIG. 22. For example, when a circuit that is disposed at a stage preceding the display 1B performs analysis of the image to be displayed in the display 1B and outputs the color signal CI, application of the present modification example is possible. It is to be noted that although in this example, the image signals and the color signal CI have been made to be separately supplied, the present disclosure is not limited to this configuration and they may be supplied, for example, in the form of one time-division-multiplexed signal.

In addition, for example, as in a display 1C illustrated in FIG. 23, an operation mode setting section 49 that sets one of a plurality of operation modes including a normal display mode M1 and a monochromatic display mode M2 may be included so as to make the operation mode setting section 49 generate the color information CI. Specifically, for example, when a user has selected the normal display mode Ml, the operation mode setting section 49 may generate the color information CI indicating that all of the red image PR, the green image PG, and the blue image PB are to be displayed and the display 1C may operate in a manner as in the case C1. In addition, for example, when the user has selected the monochromatic display mode M2, the operation mode setting section 49 may generate the color information CI indicating, for example, that only the blue image PB is to be displayed and the display 1C may operate in a manner as in the case C3. Thus, it is possible to increase the display luminance of the display 1C and therefore it is possible to reduce the power consumption in the monochromatic display mode M2.

Modification Example 6

Although in the above-mentioned embodiment, the color correction section 12 has been provided at the upstream of the memory control section 13, the present disclosure is not limited to this configuration. Alternatively, a color correction section 12D may be provided at the downstream of the memory control section 13, for example, as in a display 1D illustrated in FIG. 24. In this example, the color correction section 12D performs color-related correction on the basis of the image signal SIG3 and the synchronous signal Sync3 output from the memory control section 13. Then, the color correction section 12D generates an image signal SIG11 by performing the correction, generates a synchronous signal Sync11 that synchronizes with the image signal SIG11, and supplies the generated signals to the signal correction section 14.

Modification Example 7

Although in the above-mentioned embodiment, the signal correction section 14 has been provided at the downstream of the memory control section 13, the present disclosure is not limited to this configuration. Alternatively, the signal correction section 14 may be provided, for example, at the upstream of the memory control section 13. In the following, a display 1E according to the present modification example will be described.

FIG. 25 illustrates one configuration example of the display 1E. The display 1E includes a control section 17E and a signal correction section 14E. The control section 17E has a function which is the same as that of the control section 17 according to the above-mentioned embodiment, and is configured to generate subfield information INFO indicating which one of the red image PR, the green image PG, and the blue image PB is made in one-to-one correspondence with which subfield SF and to supply the information INFO to the signal correction section 14E. The signal correction section 14E performs correction on the signal received on the basis of the image signals SR2, SG2, and SB2 and the synchronous signal Sync2 output from the color correction section 12. Specifically, the signal correction section 14E performs correction based on the pieces of luminance information IR, IG, and IB in the plurality of adjacent subfields SF in the same way as the signal correction section 14. In that case, the signal correction section 14E performs this correction on the basis of the subfield information INFO. Then, the signal correction section 14E generates image signals SR12, SG12, and SB12 by performing the above-mentioned correction and a synchronous signal Sync12 that synchronizes with the image signals SR12, SG12, and SB12, and supplies the generated signals to the memory control section 13 and the analysis section 15.

Modification Example 8

Although in the above-mentioned embodiment, the RGB signal has been made to be input into the display 1, the present disclosure is not limited to this configuration, and a signal of any other format may be input into the display. In the following, a display 1F into which a YUV signal is input will be described.

FIG. 26 illustrates one configuration example of the display 1F. The display 1F includes an image input section 11F and a signal conversion section 40F. The image input section 11F is adapted to output image signals which are in the form of the YUV signal as image signals SY, SU, and SV, and a synchronous signal Sync0 that synchronizes with the image signals SY, SU, and SV. The signal conversion section 40F is adapted to convert (the YUV/RGB conversion) the YUV signal into an RGB signal. Specifically, the signal conversion section 40F performs the YUV/RGB conversion on the basis of the image signals SY, SU, and SV that configure the YUV signal and the synchronous signal Sync0, and generates the image signals SR1, SG1, and SB1 that configure the RGB signal and the synchronous signal Sync 1. Here, the signal conversion section 40F corresponds to one specific example of a "conversion section" in one embodiment of the present disclosure. It is to be noted that although in this example, the signal conversion section 40F has been provided at the upstream of the color correction section 12, the present disclosure is not limited to this, and the signal conversion section 40F may be provided at any location as long as it is provided at the upstream of the memory control section 13.

Modification Example 9

Although in the above-mentioned embodiment, the memory control section 13 has been configured to write the pieces of one-frame luminance information IR, IG, and IB included in the image signals SR2, SG2, and SB2 into the memory 9 and to read out only the luminance information to be displayed among them from the memory 9, the present disclosure is not limited to this configuration. For example, when the information is to be written into the memory 9, the memory control section 13 may be configured to write only the luminance information to be displayed into the memory 9.

Modification Example 10

Although in the above-mentioned embodiment, the emission luminances of the light emitting sections 30R, 30G, and 30B have been fixed regardless of the number of the subfields SF in the one-frame period, the present disclosure is not limited to this configuration. Alternatively, the emission luminances of the light emitting sections 30R, 30G, and 30B may be set to be reduced, for example, as the number of the subfields SF is reduced. Thus, for example, when the number of the subfields SF is reduced while the displaying operation is being performed (for example, when the case is being changed from the case C1 to the case C3), the possibility that the viewer feels unnaturalness due to a rapid increase in display luminance is reduced.

<2. Application Example>

In the following, an application example of any of the displays described in the above-mentioned embodiment and modification examples will be described.

FIG. 27 illustrates one example of the outside appearance of a television apparatus to which the display according to any of the above-mentioned embodiment and modification examples is applied. The television apparatus may include, for example, an image display screen section 510 including a front panel 511 and a filter glass 512, and the image display screen section 510 is configured by the display according to any of the above-mentioned embodiment and modification examples.

It is possible to apply the display according to any of the above-mentioned embodiment and modification examples to an electronic apparatus in any field including a projector, a digital camera, a book-size personal computer, a portable terminal device such as a mobile phone, a portable game machine and/or a video camera and so forth, in addition to its application to the television apparatus as mentioned above. In other words, it is possible to apply the display according to any of the above-mentioned embodiment and modification examples to electronic apparatuses in all fields that display images.

Although the present disclosure has been described by giving the example embodiment, the several modification examples, and the application example to the electronic apparatus as mentioned above, the present disclosure is not limited to the above-mentioned embodiment, modification examples, and application example, and may be modified in a variety of ways.

For example, although in the above-mentioned embodiment and modification examples, the backlight 30 includes the three light emitting sections 30R, 30G, and 30B, the present disclosure is not limited to this configuration. Alternatively, the backlight may include two or less, or four or more light emitting sections that emit light of different colors from one another, and/or may include a light emitting section or sections that emit(s) light of a color or colors other than red, green, and blue.

In addition, although, for example, in the above-mentioned embodiment and modification examples, the backlight 30 includes the light emitting sections 30R, 30G, and 30B, the present disclosure is not limited to this configuration. Alternatively, the backlight may include light emitting sections 30AR, 30AG, and 30AB on its upper half part and light emitting sections 30BR, 30BG, and 30BB on its lower half part as in, for example, a backlight 30G illustrated in FIG. 28. The light emitting sections 30AR, 30AG, and 30AB are adapted to respectively emit the red (R) light, the green (G) light, and the blue (B) light on the basis of light emission control signals CTLAR, CTLAG, and CTLAB, and the light emitting sections 30BR, 30BG, and 30BB are adapted to respectively emit the red (R) light, the green (G) light, and the blue (B) light on the basis of light emission control signals CTLBR, CTLBG, and CTLBB in the same way.

In addition, although in the above-mentioned embodiment and modification examples and so forth, the present disclosure has been applied to the liquid crystal display, the present disclosure is not limited to this application. It is possible to apply the present disclosure to any display as long as it is the display of the type configured by a display device and a light emitting device other than a so-called self-emitting type display. Specifically, the present disclosure may be applied to a display, for example, using DLP (a registered trademark) (Digital Light Processing) technology. FIG. 29 schematically illustrates one example of a projector 60 using the DLP technology. The projector 60 includes a light source system 61, a prism 63, a DMD (Digital Minor Device) 64, and a projection lens 65. In the projector 60, the red (R) light, the green (G) light, and the blue (B) light are radiated in time division from the light source system 61. The light of each color is incident upon the DMD 64 that includes a plurality of movable micro-mirrors via the prism 63. The light reflected from the DMD 64 is incident upon the projection lens 65 again via the prism 63 and projected onto the screen.

Furthermore, the technology encompasses any possible combination of some or all of the various embodiments described herein and incorporated herein.

It is possible to achieve at least the following configurations from the above-described example embodiments of the disclosure.

(1) A display device configured to display at least one image, the display device comprising:

at least one light emitter configured to emit a plurality of colored light beams, each of the plurality of colored light beams being a respective color different than the others; and a light emission controller configured to determine, based on at least one characteristic of the at least one image, one or more light beams of the plurality of colored light beams to emit in a frame period corresponding to the at least one image.

(2) The display device of (1), wherein the at least one characteristic of the at least one image comprises luminance value information related to color components of the at least one image corresponding to the respective colors of the plurality of colored light beams.

(3) The display device of (2), wherein the light emission controller is further configured to:

compare the luminance value information to a threshold value;

obtain at least one color component, excluding color components with luminance values less than the threshold value; and determine, as the one or more light beams of the plurality of colored light beams to emit in the frame period corresponding to the at least one image, the colored light beams of the color corresponding to the obtained at least one color component.

(4) The display device of (2), further comprising:

a display section configured to display the at least one image by transmitting or reflecting light from the at least one light emitter.

(5) The display device of (4), further comprising:

a display controller configured to drive the display section based on the luminance value information.

(6) The display device of (5), further comprising:

a memory configured to store the luminance information, wherein:

the display controller is configured to:

read, from the memory, only portions of the luminance information related to the color components that correspond to the one or more light beams of the plurality of colored light beams to emit in the frame period corresponding to the at least one image; and drive the display section based on the read luminance information.

(7) The display device of (6), wherein the display controller is further configured to:

write into memory only the luminance information related to the color components that correspond to the one or more light beams of the plurality of colored light beams to emit in the frame period corresponding to the at least one image.

(8) The display device of (1), wherein the light emission controller is further configured to extend a light emission time of the one or more light beams of the plurality of colored light beams to emit in the frame period corresponding to the at least one image.

(9) The display device of (1), wherein the light emission controller is further configured to control a number of light emission periods of the one or more light beams of the plurality of colored light beams to emit in the frame period corresponding to the at least one image.

(10) The display device of (1), wherein the light emission controller is further configured to time-divisionally control the light emission of the one or more light beams of the plurality of colored light beams to emit in the frame period corresponding to the at least one image.

(11) The display device of (10), wherein the light emission controller is further configured to control light emission periods of the respective one or more light beams of the plurality of colored light beams to emit in the frame period corresponding to the at least one image such that the respective light emission periods overlap at least partially with one another.

(12) The display device of (1), wherein the light emission controller is further configured to control a light emission start time and/or a light emission finish time of the one or more light beams of the plurality of colored light beams to emit in the frame period corresponding to the at least one image.

(13) The display device of (1), wherein the light emission controller is further configured to control an emission luminance of the one or more light beams of the plurality of colored light beams to emit in the frame period corresponding to the at least one image.

(14) The display device of (1), wherein the plurality of colored light beams have the respective colors of red, green and blue.

(15) The display device of (1), further comprising a converter configured to convert a signal other than an RGB signal into an RGB signal.

(16) The display device of (1), wherein the display device is a head-mounted display.

(17) The display device of (1), wherein the display device is a projector.

(18) The display device of (1), wherein the display device is a field sequential driving type device.

(19) A light emission controller configured to control at least one light emitter, the light emission controller comprising:

an analyzer configured to:

receive a plurality of image signals, each of the plurality of image signals corresponding to a respective color;

create a plurality of comparison results by comparing a plurality of luminance values, based on a respective one of the plurality of image signals, to at least one threshold value; and determine which of the plurality of image signals to display based on the plurality of comparison results; and a controller configured to control the at least one light emitter based on the determination of the analyzer.

(20) A light emitting device, comprising:

a plurality of light emitters, each of the plurality of light emitters configured to emit light of a different color;

a light emission controller configured to:

receive a plurality of image signals, each of the image signals corresponding to a respective one of the plurality of colors;

determine at least one of the plurality of light emitters to emit light based on the plurality of image signals; and output a control signal to each of the plurality of light emitters based on the determination of the light emission controller.

It should be understood by those skilled in the art that various modifications, combinations, sub-combinations and alterations may occur depending on design requirements and other factors insofar as they are within the scope of the appended claims or the equivalents thereof.

REFERENCE SIGNS LIST

1 to 3, 1A to 1F Display
9 Memory
11, 11F Image input section
12, 12D Color correction section
13 Memory control section
14, 14E Signal correction section
15 Analysis section
16 Threshold value setting section
17, 17E, 47 Control section
18 Backlight control section
20 Liquid crystal display section
21 Timing control section
22 Gate driver
23 Data driver
24 Pixel array section
30 Backlight
30R, 30G, 30B Light emitting section
40F Signal conversion section
49 Operation mode setting section
43 Signal generation section
60 Projector
61 Light source
63 Prism
64 DMD
65 Projection lens
CI Color information
CTLR, CTLG, CTLB Light emission control signal
Pix Pixel
PR Red image
PG Green image
PB Blue image
PY Yellow image
SBL Backlight control signal
SF Subfield
SMEM Memory control signal
SR1, SG1, SB1, SR2, SG2, SB2, SR12, SG12, SB12, SY, SU, SV, SIG3, SIG4, SIG11, S10 Image signal
SSIG Control signal
Sync1 to Sync4, Sync10, Sync11, Sync12, SyncB Synchronous signal

The invention claimed is:

1. A display device configured to display at least one moving image, the display device comprising:

at least one light emitter configured to emit light beams of a plurality of different colors; and a light emission controller configured to:

(A) determine, based on at least one characteristic of the at least one moving image during a first frame period, a first set of one or more colors from the plurality of different colors that the at least one light emitter is configured to emit;

(B) determine one or more light emission periods within the first frame period, each light emission period corresponding respectively to the one or more colors determined in (A);

(C) for each color determined in (A), cause the at least one light emitter to emit a light beam having that color during the corresponding light emission period within the first frame period;

(D) determine, based on the at least one characteristic of the at least one moving image during a second frame period, a second set of one or more colors from the plurality of different colors that the at least one light emitter is configured to emit, the second set of one or more colors comprising fewer colors than the first set of one or more colors;

(E) determine one or more light emission periods within the second frame period, each light emission period corresponding respectively to the one or more colors determined in (D); and (F) for each color determined in (D), cause the at least one light emitter to emit a light beam having that color during the corresponding light emission period within the second frame period, wherein the first set of one or more colors and the second set of one or more colors comprise at least one color in common, and the light emission period for the at least one color within the second frame period is longer than the light emission period for the at least one color within the first frame period.

2. The display device of claim 1, wherein the at least one characteristic of the at least one moving image comprises luminance information related to color components of the at least one moving image corresponding respectively to the plurality of different colors that the at least one light emitter is configured to emit.

3. The display device of claim 2, wherein the light emission controller is further configured to:

compare the luminance information of the at least one moving image during the second frame period to a threshold value;

obtain at least one color component, excluding one or more color components with luminance values less than the threshold value, wherein the color corresponding to the obtained at least one color component is included in the second set of one or more colors determined in (D).

4. The display device of claim 2, further comprising:

a display section configured to display the at least one moving image by transmitting or reflecting light from the at least one light emitter.

5. The display device of claim 4, further comprising:

a display controller configured to drive the display section based on the luminance information.

6. The display device of claim 5, further comprising:

a memory configured to store the luminance information, wherein:

the display controller is configured to, for the second frame period:

read, from the memory, only portions of the luminance information related to the color components that correspond to the one or more colors in the second set of one or more colors determined in (D); and drive the display section during the second frame period based on the read luminance information.

7. The display device of claim 6, wherein the display controller is further configured to, for the second frame period:

write into memory only the luminance information related to the color components that correspond to the one or more colors in the second set of one or more colors determined in (D).

8. The display device of claim 1, wherein the light emission periods determined in (E) have a same length, and wherein the light emission controller is further configured to determine the length by dividing a length of the second frame period by a number of colors in the second set of one or more colors.

9. The display device of claim 1, wherein the light emission periods determined in (E) are non-overlapping.

10. The display device of claim 1, wherein at least two of the light emission periods determined in (E) overlap at least partially with one another.

11. The display device of claim 1, wherein the light emission controller is further configured to control, for at least one color determined in (D), a light emission start time and/or a light emission finish time within the second frame period.

12. The display device of claim 1, wherein the light emission controller is further configured to control, for at least one color determined in (D), an emission luminance within the second frame period.

13. The display device of claim 1, wherein the plurality of different colors that the at least one light emitter is configured to emit are red, green and blue.

14. The display device of claim 1, further comprising a converter configured to convert a signal other than an RGB signal into an RGB signal.

15. The display device of claim 1, wherein the display device is a head-mounted display.

16. The display device of claim 1, wherein the display device is a projector.

17. The display device of claim 1, wherein the display device is a field sequential driving type device.

18. A light emitting device, comprising:

a plurality of light emitters, each of the plurality of light emitters configured to emit light of a different color of a plurality of colors;

a light emission controller configured to:

receive a plurality of image signals, each of the image signals corresponding to a respective one of the plurality of colors that the plurality of light emitters are configured to emit;

determine, based on the plurality of image signals, one or more light emitters to emit light in an image frame period, a number of respective light emission periods within the image frame period during which the determined ones of the light emitters are to emit light, and respective durations of the determined light emission periods during which the determined ones of light emitters are to emit light, wherein the number of respective light emission periods is smaller than a number of different colors of the plurality of colors that the plurality of light emitters are configured to emit; and output a control signal to each of the plurality of light emitters based on the determinations of the light emission controller.

* * * * *